US011104509B2

(12) United States Patent
Kim et al.

(10) Patent No.: US 11,104,509 B2
(45) Date of Patent: Aug. 31, 2021

(54) CARGO CONTAINER

(71) Applicant: SEOUL NATIONAL UNIVERSITY OF TECHNOLOGY CENTER FOR INDUSTRY COLLABORATION, Seoul (KR)

(72) Inventors: Jong Bong Kim, Seoul (KR); Eun Young Lim, Seoul (KR); Young Woon Choi, Guri-si (KR)

(73) Assignee: SEOUL NATIONAL UNIVERSITY OF TECHNOLOGY CENTER FOR INDUSTRY COLLABORATION, Seoul (KR)

( * ) Notice: Subject to any disclaimer, the term of this patent is extended or adjusted under 35 U.S.C. 154(b) by 763 days.

(21) Appl. No.: 15/826,994

(22) Filed: Nov. 30, 2017

(65) Prior Publication Data

US 2018/0155119 A1 Jun. 7, 2018

(30) Foreign Application Priority Data

Dec. 1, 2016 (KR) ..... 10-2016-0162751
Dec. 1, 2016 (KR) ..... 10-2016-0162766
Apr. 19, 2017 (KR) ..... 10-2017-0050255

(51) Int. Cl.
*B65D 88/52* (2006.01)
*B65D 90/00* (2006.01)

(52) U.S. Cl.
CPC ..... *B65D 88/526* (2013.01); *B65D 88/522* (2013.01); *B65D 88/524* (2013.01); *B65D 90/0026* (2013.01)

(58) Field of Classification Search
CPC .. B65D 88/526; B65D 88/528; B65D 88/522; B65D 88/524; B65D 90/0086; B65D 90/008; B65D 90/08; A47G 9/00
USPC ..... 220/1.5; 280/423.1
See application file for complete search history.

(56) References Cited

U.S. PATENT DOCUMENTS

| | | | | |
|---|---|---|---|---|
| 6,394,267 | B1 * | 5/2002 | Craig | B65D 88/528 206/321 |
| 2007/0000921 | A1 * | 1/2007 | Butler | B65D 88/528 220/1.5 |
| 2010/0025397 | A1 * | 2/2010 | Krohn | B65D 88/522 220/6 |
| 2014/0183187 | A1 * | 7/2014 | Nemoto | B65D 88/127 220/1.5 |

(Continued)

FOREIGN PATENT DOCUMENTS

| | | |
|---|---|---|
| CN | 103434767 | 12/2013 |
| JP | 8-113476 | 5/1996 |
| KR | 20-0276484 | 5/2002 |

(Continued)

*Primary Examiner* — Anthony D Stashick
*Assistant Examiner* — Raven Collins
(74) *Attorney, Agent, or Firm* — Kile Park Reed & Houtteman PLLC

(57) ABSTRACT

A cargo container is provided. The cargo container includes a frame part, a panel part, a plurality of lead screws and a plurality of guide brackets, so that the cargo container may be operated in a fixing mode or a folding mode according to loading or unloading of cargo. Thus, the volume in the folding mode may be reduced, and transport with stacked may be facilitated, so that a highly efficient cargo container may be provided that is easy to store and transport.

6 Claims, 21 Drawing Sheets

(56) References Cited

U.S. PATENT DOCUMENTS

2014/0263379 A1* 9/2014 Brennan, Jr. ..... B65D 90/08
220/720

FOREIGN PATENT DOCUMENTS

| | | |
|---|---|---|
| KR | 20-0393366 | 8/2005 |
| KR | 10-1529699 | 6/2015 |
| WO | 2016/128208 | 8/2016 |

* cited by examiner

CARGO CONTAINER

CROSS REFERENCE TO RELATED APPLICATION

This application claims priority from and the benefit of Korean Patent Applications No. 2016-0162751 filed on Dec. 1, 2016, No. 2016-0162766 filed on Dec. 1, 2016 and No. 10-2017-0050255 filed on Apr. 19, 2017, which are hereby incorporated by reference for all purposes as if fully set forth herein.

BACKGROUND OF THE INVENTION

Field of the Invention

Exemplary embodiments of the present invention relate to a cargo container. More particularly, exemplary embodiments of the present invention relate to a cargo container that is easily stored and transported.

Discussion of the Background

In accordance with expanding trade organizations by country and political trade agreement to increase import of advanced technology, intercontinental trade is actively under way today. Trade may be broadly categorized into export trade and import trade, and there are countries that mainly carry out export trade, while there are countries that mainly carry on import trade.

In countries where import trade is predominant, a number of cargo containers are driven into the countries. Many of these cargo containers do not lose their volume even after unloading cargo, and the problem of storing and transporting cargo containers between trading countries is emerging.

Thus, in Korea utility model registration laid-open No. 20-0393366 (title: hinge for foldable container box and foldable container box using the same), a foldable container is disclosed, which includes a first support part coupled to one of many panels, a second support part coupled to another of the many panels and a flexible coupling part coupling the first support part to the second support part, so that transport thereof is convenient.

However, in the foldable container, a lower face and side face portions are provided separate, and thus an assembly process is additionally required. Therefore, it may take a long time to assemble, which may cause troubles to a user.

SUMMARY OF THE INVENTION

Exemplary embodiments of the present invention provide a cargo container capable of reducing transport cost, reducing transport time and easily storing the same, and having great efficiency and safety.

Additional features of the invention will be set forth in the description which follows, and in part will be apparent from the description, or may be learned by practice of the invention.

An exemplary embodiment of the present invention discloses a cargo container operated in a folding mode and a fixing mode. The cargo container includes a frame part, a panel part, a plurality of lead screws and a plurality of guide brackets. The frame part includes a plurality of upper frames, a plurality of lower frames and a plurality of side frames and has a hexahedral shape. The panel part is positioned at surfaces defined by the frame part. The panel part includes a side panel portion having first side panels disposed to face each other with respect to a first axis, and second side panels disposed to face each other with respect to a second axis substantially perpendicular to the first axis. A plurality of folding lines is formed at the first side panels. The lead screws are attached on the lower frames disposed to face each other with respect to the first axis, and control operations in the folding mode and the fixing mode according to a rotation direction. The guide brackets are penetrated by the lead screws, and move in a reciprocating motion by rotation of the lead screws. In case of the folding mode, the lead screw is rotated in one direction, and the guide brackets penetrated by the lead screw, which are formed at both end portions, inwardly move in a straight line, so that the side frames, end portions of which are connected to the guide brackets, are laid down. In case of the fixing mode, the lead screw is rotated in another direction, the guide brackets penetrated by the lead screw, which are formed at both end portions, outwardly move in a straight line, so that the side frames that is laid down in the folding mode are stood up.

Another exemplary embodiment of the present invention discloses a cargo container operated in a folding mode and a fixing mode. The cargo container includes a frame part, a panel part, a plurality of lead screws, a plurality of guide brackets and a plurality of guide panels. The frame part includes a plurality of upper frames, a plurality of lower frames and a plurality of side frames. The panel part is positioned at surfaces defined by the frame part. The panel part includes a side panel portion having first side panels disposed to face each other with respect to a first axis, and second side panels disposed to face each other with respect to a second axis substantially perpendicular to the first axis. A plurality of folding lines is formed at the first side panels. The lead screws are attached on the lower frames disposed to face each other with respect to the first axis, and control operations in the folding mode and the fixing mode according to a rotation direction. The guide brackets are penetrated by the lead screws. A guide groove is formed on at least one outer face of each guide bracket by a predetermined depth. The guide panels surround a side portion of the lower frames to which the lead screw is attached. A guide line protrudes from an inner side face by a predetermined height corresponding to the guide groove. In case of the folding mode, the first side panels folded according to the folding lines are respectively overlaid on the inner side face of the associated second side panel, and the guide brackets inwardly move according to the guide line by rotation of the lead screw in one direction, so that the side frames, end portions of which are connected to the guide brackets, are laid down. In case of the fixing mode, the lead screw is rotated in another direction, the guide brackets outwardly move in a straight line according to the guide line, so that the side frames that is laid down in the folding mode are stood up and the folded first side panels are unfolded and fixed.

Still another exemplary embodiment of the present invention discloses a cargo container operated in a folding mode and a fixing mode. The cargo container includes a frame part, a panel part, a plurality of lead screws and a plurality of guide brackets. The frame part includes a frame part including a plurality of upper frames, a plurality of lower frames and a plurality of side frames and having a hexahedral shape. The panel part is positioned at surfaces defined by the frame part, the panel part including a lower panel and a plurality of side panels. The lead screws are attached on inner side faces of the lower frames at front and rear disposed to face each other, and control operations in the folding mode and the fixing mode according to a rotation direction. The guide brackets are penetrated by both end portions of the lead screws, and convert rotational motion into linear motion by rotation of the lead screws. In case of the folding mode, the lead screw is rotated in one direction, and the guide brackets inwardly move, so that the side frames and the side panels are folded and the upper frame descends. In case of the fixing mode, the lead screw is rotated in another direction, the guide brackets outwardly move, so that the side frames and the side panels are unfolded.

According to the present invention, the cargo container according to an exemplary embodiment of the present invention may be reduced in volume by the sliding side frames, and thus transport with stacked may be available, thereby reducing transport cost.

Further, the cargo container according to an exemplary embodiment of the present invention may be improved in safety by the fixing bracket and the correcting part.

In addition, the cargo container according to an exemplary embodiment of the present invention may prevent the departure of the cargo container by an external force in an operation mode of the side frame by the guide panel.

Further, in the cargo container according to an exemplary embodiment of the present invention, the impact may be reduced by the protruding part when the side frames are folded.

In addition, in the cargo container according to an exemplary embodiment of the present invention, the side frames and the side panels are folded and reduced in volume, and thus transport with stacked may be available, thereby reducing transport cost.

Further, the cargo container according to the embodiment of the present invention may be improved in safety by a correction protruding portion and a fixing bracket.

In addition, the cargo container according to the embodiment of the present invention may be improved in convenience as an integrated type capable of a single operation.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
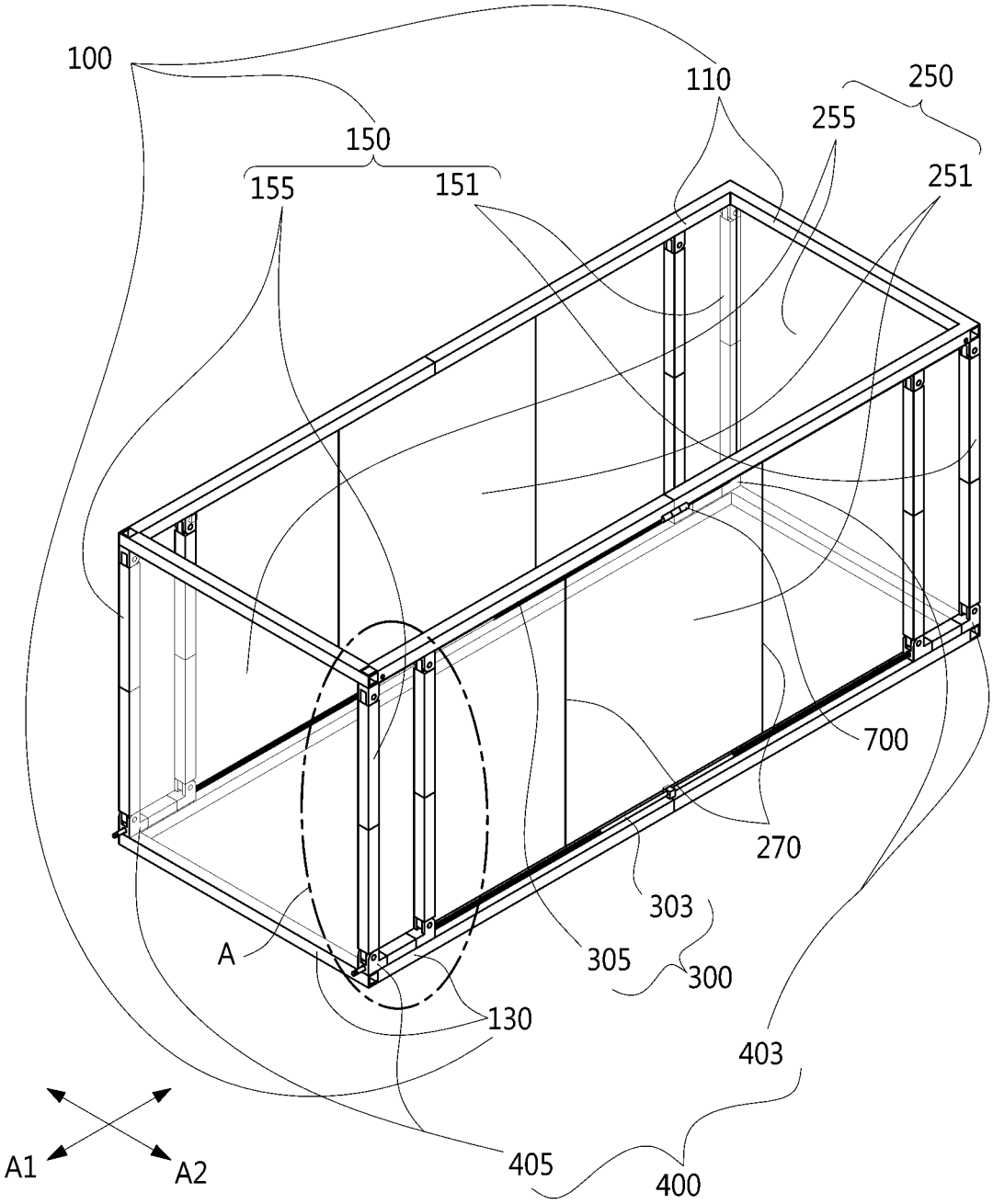
FIGS. 1 and 2 are perspective views illustrating a cargo container according to an exemplary embodiment of the present invention.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be described in detail with reference to the accompanying drawings.

Figure 2:
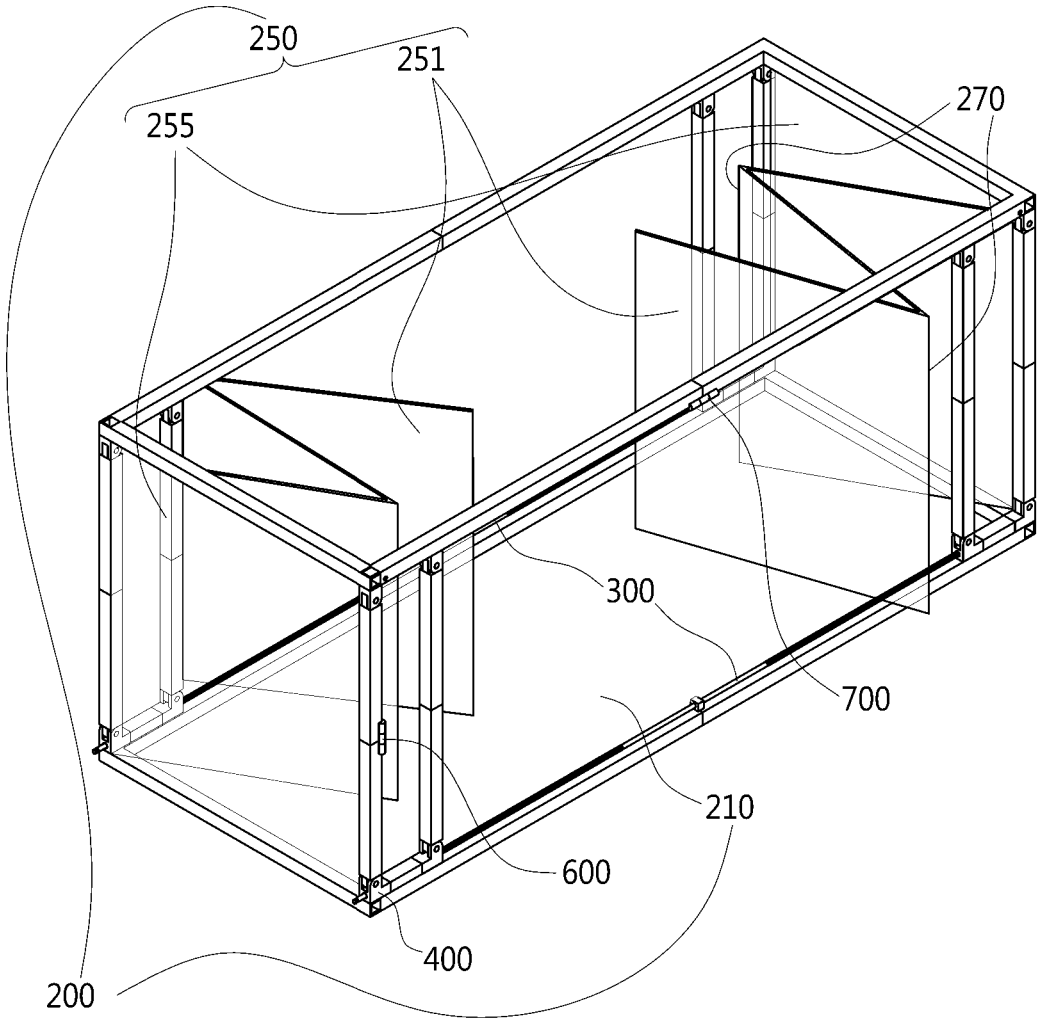

FIGS. 1 and 2 are perspective views illustrating a cargo container according to an exemplary embodiment of the present invention.

Referring to FIGS. 1 and 2, the cargo container may include a frame part 100, a panel part 200, a lead screw 300, a guide bracket 400, a protruding part 500 and a correcting part 600. More particularly, FIG. 1 is a perspective view of the cargo container with the panel part 200 fixed to the frame part 100, and FIG. 2 is a perspective view of the cargo container with the panel part 200 folded.

The frame part 100 is a framework of the cargo container, which may be a hexahedral shape. The frame part 100 may include upper frames 110, lower frames 130, and side frames 150.

The upper frames 110 may be located at the top of the frame part 100. In an exemplary embodiment, a plurality of upper frames 110 may be provided in a form of a rectangular frame.

The lower frames 130 may be located at the bottom of the frame part 100. In other words, the lower frames 130 may be spaced from the upper frame 110 in a lower direction by a predetermined distance. In an exemplary embodiment, the lower frames 130 may be provided in a form of a rectangular frame, similar to the upper frames 110.

The lead screw 300, described below, may be located on the upper face of a pair of lower frames 130 facing each other with respect to a first axis. The lead screw 300 will be described in more detail below.

The side frames 150 may be located on the side of the frame part 100. More specifically, one end of the side frames 150 may be connected to the upper frame 110, and another end of the side frames 150 may be connected to the guide bracket 400, which will be described later, attached on the lower frames 130.

The side frames 150 may be divided into first side frames 151 and second side frames 155 according to the moving direction of the guide bracket 400 in the folding mode of the cargo container. In other words, in the folding mode, another end of the first side frames 151 may be moved in the first direction according to the guide bracket 400, which is moved in the first direction. In addition, another end of the second side frames 155 may be moved in a second direction opposite to the first direction according to the guide bracket 400, which is moved in the second direction. This will be explained in more detail in the explanation of the operation according to the folding mode of the cargo container.

The panel part 200 is provided in the form of a plate having a predetermined width and may be placed on the surfaces defined by the frame part 100.

The panel part 200 may include a lower panel part 210 and a side panel part 250. The lower panel part 210 may be attached to a surface defined by the lower frames 130 and positioned there.

The side panel portion 250 may be located on a plurality of surfaces defined by the upper frame 110, the lower frame 130 and the side frames 150.

The side panel portion 250 may include first side panels 251 and second side panels 255. The first side panels 251 may be positioned facing each other with respect to a first axis A1, as shown in FIG. 1.

The first side panels 251 may be fixed at least one side edge to the side frames 150, respectively.

A plurality of folding lines 270 may be formed on the surfaces of the first side panels 251, respectively. A plurality of the folding lines 270 may be formed in a direction substantially parallel to the side frames 150. The plurality of folding lines 270 may induce folding of the first side panels 251 in the folding mode. In an exemplary embodiment, the first side panels 251 may be folded in zigzag form by the plurality of folding lines 270. Herein, the plurality of folding lines 270 may be formed at intervals smaller than the width of the second side panels 255. Thus, the first side panels 251 may be overlaid on the inner side face of the second side panel 255 with respect to at least one side edge fixed to the side frames 150.

The first side panels 251 may be detachably attached to the frame part 100 by a binding part 700 that is optionally provided. Accordingly, in the fixing mode of the cargo container, the first side panels 251 are attached to the frame part 100 by the binding part 700, so that folding due to an external impact may be prevented. The binding part 700 may be provided in plurality.

The second side panels 255 may be positioned facing each other with respect to a second axis A2 substantially perpendicular to the first axis A1. The second side panels 255 may be fixed to the upper frame 110 and the side frames 150 with at least one edge except for the lower end portions. In other words, the lower end portions of the second side panels 255 may be separated from the lower frame 130. Thus, in the folding mode of the cargo container, the second side panels 255 on which the first side panels 251 are overlaid may be moved with the side frames 150 along the guide brackets 400, as will be described later.

The cargo container according to an exemplary embodiment of the present invention may further include an upper panel part and a lower panel part in addition to the side panel part 250. More specifically, the upper panel part may be formed on a face defined by the upper frames 110, and the lower panel part may be formed on a face defined by the lower frames 130. The upper panel part and the lower panel part may or may not be included depending on the intended use.

Figure 3:
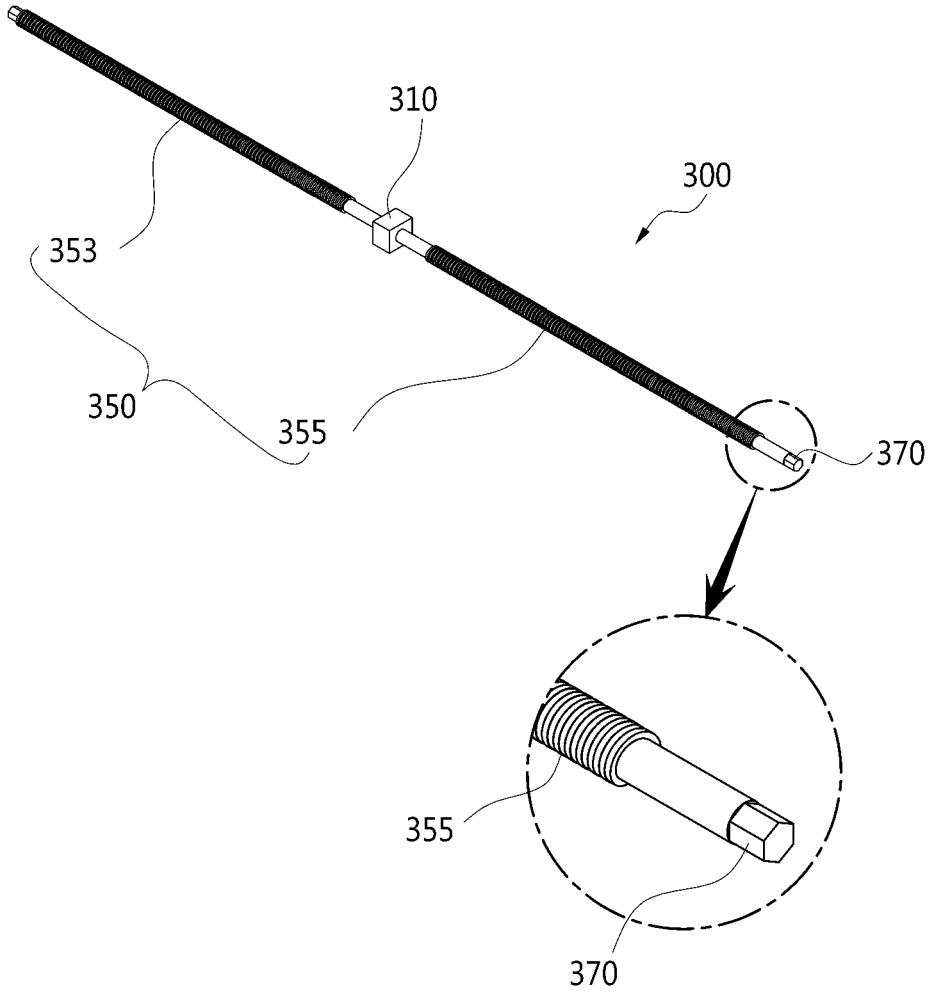
FIG. 3 is a perspective view illustrating a lead screw of the cargo container in FIGS. 1 and 2.

FIG. 3 is a perspective view illustrating a lead screw of the cargo container in FIGS. 1 and 2.

Referring to FIGS. 1 to 3, a lead screw 300 may be provided in a rod shape having a predetermined length.

The lead screw 300 is provided in plurality and may be positioned on the upper faces of the lower frames 130 facing each other with respect to the first axis A1. In an exemplary embodiment, the lead screw 300 may include a first lead screw 303 and a second lead screw 305. The first lead screw 303 may be attached to the upper face of the lower frame 130 located at one side with respect to the front side. Also, the second lead screw 305 may be attached to the upper face of the lower frame 130 located on another side with respect to the front side.

Each of the lead screws 300 may include a lead screw holder 310, a screw region 350, and a handle portion 370.

The lead screw holder 310 may be positioned through a central portion of the lead screw 300.

The lead screw holder 310 may fix the lead screw 300 to the upper face of the lower frame 130. Accordingly, during the rotation operation of the lead screw 300 by the folding mode and the fixing mode, the deviation of the lead screw 300 due to the impact may be prevented.

The screw region 350 is formed on the surface of the lead screw 300 and may include screw threads having directionality. The screw region 350 may include a first screw region 353 and a second screw region 355.

The first screw region 353 may be located at one side with respect to the lead screw holder 310. A screw thread protruding in a first direction may be formed on the first screw region 353.

The second screw region 355 may be located at another side of the lead screw holder 310. A screw thread protruding in a second direction opposite to the first direction may be formed on the second screw region 355.

In other words, the lead screws 300 may include the first screw region 353 and the second screw region 355, which have screw threads whose directions are opposite to each other with respect to the lead screw holder 310. Accordingly, in the rotation operation of the lead screw 300 by the folding mode and the fixing mode, the guide brackets 400 described later, which are respectively positioned at both end portions of the lead screw 300, approach the lead screw holder 310, or move away from the screw holder 310.

The handle portion 370 may transmit external power to the first and second lead screws 310. In other words, the handle portion 370 may be a handle formed at one ends of the lead screws 300, respectively, for rotating the lead screws 300.

In an exemplary embodiment, a user may control the operation mode of the cargo container by rotating the lead screw 300 in the clockwise or counterclockwise direction with the handle portion 370. In other words, the rotation direction of the handle portion 370 may determine the operation of the folding mode or the fixing mode of the cargo container.

In FIG. 3, the handle portion 370 is formed at the outer end portion of the second screw region 355, but the handle portion 370 may be additionally formed at the outer end portion of the first screw region 353. In this case, the first and second screw regions 353 and 355 may be independently driven by the two handle portions, so that the screw threads formed in the first and second screw regions 353 and 355 may have different directions, but may have substantially the same direction.

Meanwhile, in FIGS. 1 and 2, the lead screws 300 are disposed on the lower frames 130, but alternatively, the lead screws 300 may be disposed on the upper frames 110. In this case, the operation of the cargo container described later with reference to FIGS. 5 to 7 may be performed in a manner of upside down, which corresponds to the case that the cargo container is substantially turned over, and thus the principle of the present invention applied to the present embodiment and the following embodiments and claim scopes written in the claims of the present invention are not limited by specifying up and down.

Figure 4:
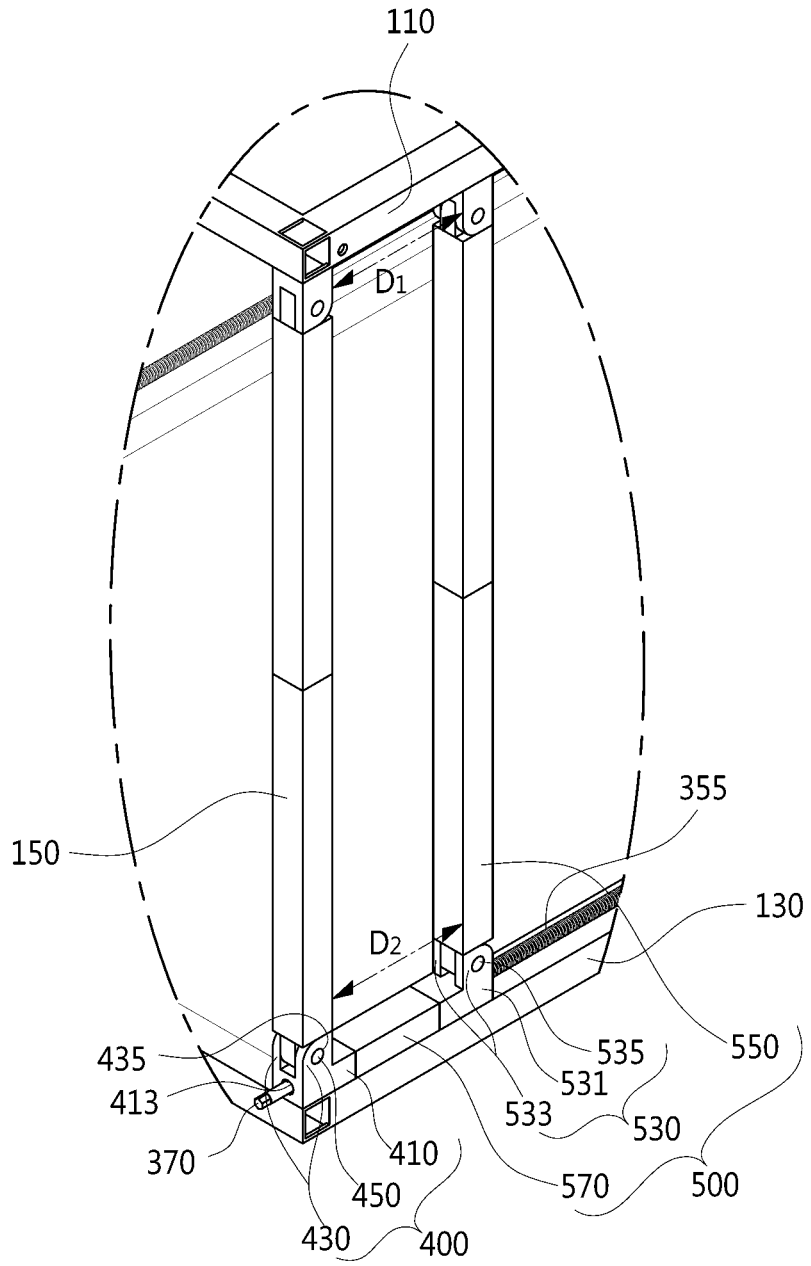
FIG. 4 is a perspective view illustrating a guide bracket and a correcting part of the cargo container in FIGS. 1 and 2.

FIG. 4 is a perspective view illustrating a guide bracket and a correcting part of the cargo container in FIGS. 1 and 2.

Referring to FIGS. 1 to 4, the guide bracket 400 may be positioned through both end portions of the lead screw 300. The guide bracket 400 may convert the rotational motion of the lead screw 300 into a linear motion.

The guide bracket 400 may be provided in plurality. More particularly, the guide bracket 400 may include first guide brackets 403 located at one end portions of the lead screws 300 and second guide brackets 405 positioned at another end portions of the lead screws 300.

Each of the guide brackets 400 may include a body 410, sidewalls 430, and a fixing pin 450.

A first through-hole 413 may be formed through the body 410. The first through-hole 413 may be formed through the side portion of the body 410. In other words, the first through-hole 413 may be formed through the body 410 in the direction of the second axis A2.

The lead screw 300 may penetrate the first through-hole 413. The inner wall of the first through-hole 413 may be formed with a helical screw groove (not shown) parallel to one direction or another direction. The screw groove may be formed in a shape corresponding to the protruding screw threads in the screw region 350 on the lead screw 300. Accordingly, the lead screw 300 may be stably rotated along the screw groove.

The sidewalls 430 may protrude from the body 410 by a predetermined height. The sidewalls 430 may be formed substantially parallel to the first axis A1 at a predetermined interval. The side frames 150 may be located between the sidewalls 430.

A second through-hole 435 may be formed through the sidewalls 430. More specifically, the sidewalls 430 may have a second through-hole 435 having a predetermined width in the direction of the first axis A1.

The fixing pin 450, which will be described later, may penetrate the second through-hole 435. More specifically, the fixing pin 450 may be positioned through the side frame 150 located between the sidewalls 430. Accordingly, the guide bracket 400 and the side frame 150 are coupled by the fixing pin 450, so that the lead screw 300, the guide bracket 400, and the side frame 150 may be integrally formed.

Accordingly, the rotational forces of the lead screw 3000 may be transmitted to the guide brackets 400 and the side frames 150. Thus, the movement of the lead screw 300, the guide bracket 400, and the side frame 150 may be continuous.

The continuous operation of the guide bracket 400 and the side frame 150 according to the rotation of the lead screw 300 will be described in more detail in the description of the operation mode of the cargo container to be described later.

At least one corner portion of the sidewall 430 may be provided with a curved face. In this case, the corner portion may be positioned to correspond to a curved face formed on the side frames 150. Thus, collision between the side frames 150 and the sidewalls 430 during the operation mode of the cargo container may be prevented.

The correcting part 500 may include a correction bracket 530, a correction frame 550 and a connecting member 570. The correcting part 500 may correct the dislocation of the side frames 150 in the operating mode of the cargo container. The correction bracket 530 may be provided in plurality.

A plurality of the correction brackets 530 may be penetrated by both end portions of the lead screw 300, respectively. The plurality of correction brackets 530 may be inwardly spaced apart from the guide brackets toward the lead screw holder 310, by a predetermined distance.

The correction bracket 530 may include a body 531, sidewalls 533, and a fixing pin 535. The configurations 531, 533, and 535 of the correction bracket 530 may have substantially the same shape and effect as the configurations 410, 430, and 450 of the guide bracket 400 described above. Therefore, a detailed description of the configurations 531, 533, and 535 will be omitted.

The correction frame 550 may be provided in plurality. A plurality of correction frames 550 may be provided having substantially the same height as the side frames 150.

One end portions of the correction frames 550 may be fixed to the upper frames 110 located at the side portions, respectively. In other words, one end portions of the correction frames 550 may be fixed to the lower faces of the upper frames 110 facing each other with respect to the first axis A1. Herein, each one end portion of the correction frames 550 may be positioned apart from the associated one end portion of the side frames 150 by D1.

In addition, each another end portion of the correction frames 550 may be connected to the associated correction bracket 530. Herein, another end portion of the correction frames 550 may be positioned at a distance D2 from another end portion of the associated side frame 150. D2 may be substantially the same as D1. In other words, the correction frame 550 may be positioned substantially parallel to the side frames 150 at a predetermined interval.

Accordingly, the correction frames 550 may help effective sliding foldability of the side frames 150 and the second side panels 255 by preventing dislocation due to the impact of the side frames 150 when the side frames 150 move.

The connecting member 570 may be provided in plurality. In an exemplary embodiment, a plurality of connecting members 570 may be provided in a form of a rod having a predetermined length.

A plurality of connecting members 570 may be configured to maintain the spacing between the correction frames 550 and the side frames 150, as described above. Accordingly, each of the connecting members 570 may be penetrated by the lead screw 300, and be positioned between the guide brackets 400 and the correction brackets 530.

More specifically, the side portions of the connecting members 570 may be formed with through-holes (not shown). In an exemplary embodiment, a screw groove (not shown) may be formed at inner walls of the through-holes. The screw groove may be formed to correspond to the protruding screw threads in the screw regions 350.

The lead screw 300 may pass through the through-hole of the connecting members 570. The connecting members 570 may be positioned respectively in the spaces between the guide brackets 400 and the correction brackets 530 spaced apart from each other.

The connecting member 570 may be provided in a separate and independent configuration, as described above, or at least one side of the connecting member 570 may be connected with the guide bracket 400 or the correction bracket 530.

More specifically, in an exemplary embodiment, the connecting member 570 may extend from one end of the correction bracket 530 or may extend from one end of the guide bracket 400.

In another exemplary embodiments, the connecting member 570 may be integrally formed with the guide bracket 400 and the correction bracket 530.

The cargo container according to an exemplary embodiment of the present invention may be prevented from leaning in the operation according to the fixing mode and the folding mode by the correcting part 500, thereby providing a cargo container with improved safety.

Hereinafter, FIG. 6, which will be described later, is referred in advance to describe the protruding part 600 of the cargo container.

Referring to FIGS. 1 to 6, the protruding part 600 may have a rod shape of a predetermined length, and may restrict movement of the side frame 150 in the folding mode of the cargo container according to an embodiment of the present invention.

The protruding part 600 may include first protruding parts 610 and second protruding parts 650.

The first protruding parts 610 are provided in plurality, and may be individually attached to the corner portions of the upper frames 110, respectively. In the exemplary embodiment, the first protruding parts 610 may be attached to the lower face of the corner portion of the upper frame 110 and downwardly protrude by a predetermined length.

The second protruding parts 650 are provided in a plurality and may be individually attached to the corner portions of the lower frames 110, respectively. In the exemplary embodiment, the second protruding parts 650 may be attached to the upper face of the corner portion of the lower frame 130 and upwardly protrude by a predetermined length. Herein, the second protruding parts 650 may be positioned on substantially the same axis as the first protruding parts 610, respectively.

The first and second protruding parts 610 and 650 may restrict the folding of the side frame 150 in the folding mode of the cargo container. More specifically, in the folding mode, the side frames 150 of the cargo container may be folded, so that the upper frames 110 may descend.

The first protruding parts 610 formed in the descending upper frames 110 may contact with the second protruding parts 650 of the lower frames 130 at a specific height. Thus, the descent of the upper frames 110 may be restricted by the first and second protruding parts 610 and 650.

The conventional foldable container does not teach a configuration for improving durability, and thus may cause damage to the container in the folding of the side portion for reducing the volume thereof.

In contrast, the cargo container according to an exemplary embodiment of the present invention may absorb impact of the frame part in the folding mode by the protruding parts. Accordingly, a highly reliable cargo container that may be used for a long time may be provided.

Figure 5:
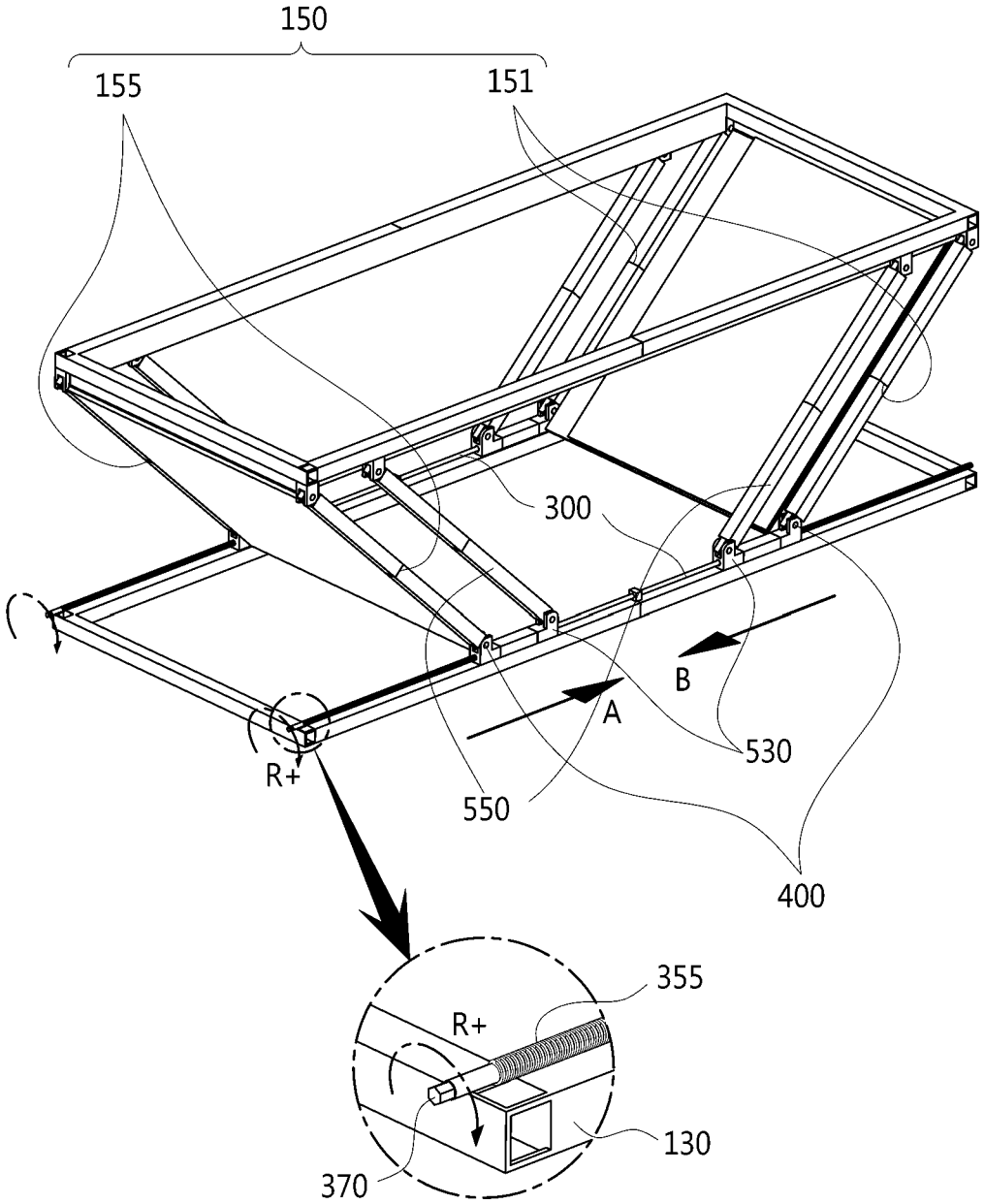
FIGS. 5 to 7 are perspective views for explaining the operation of the cargo container in FIGS. 1 and 2.
Figure 6:
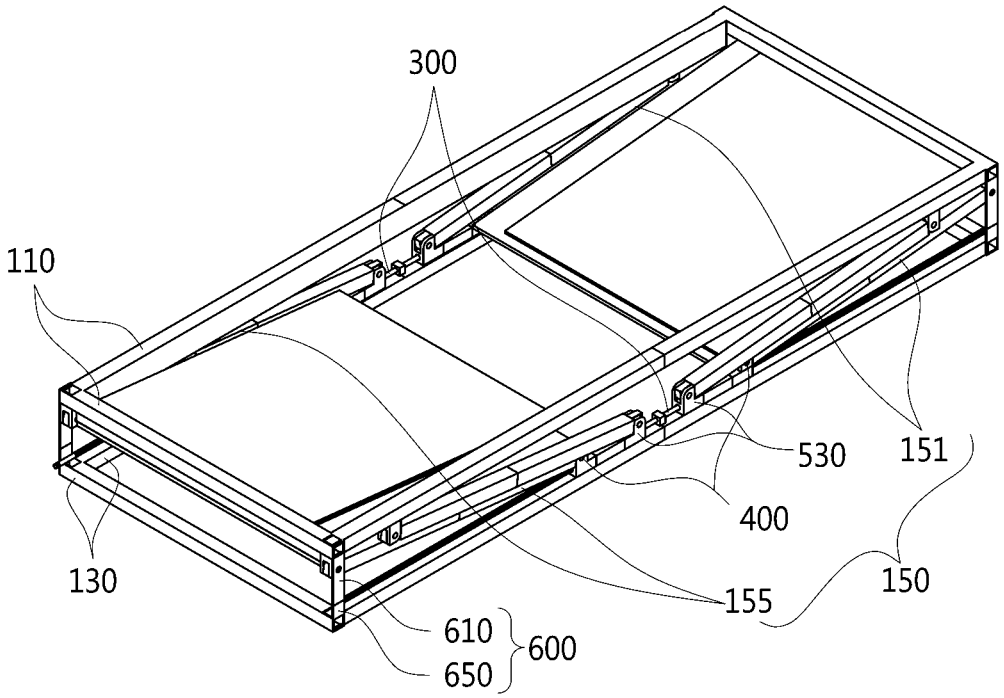
Figure 7:
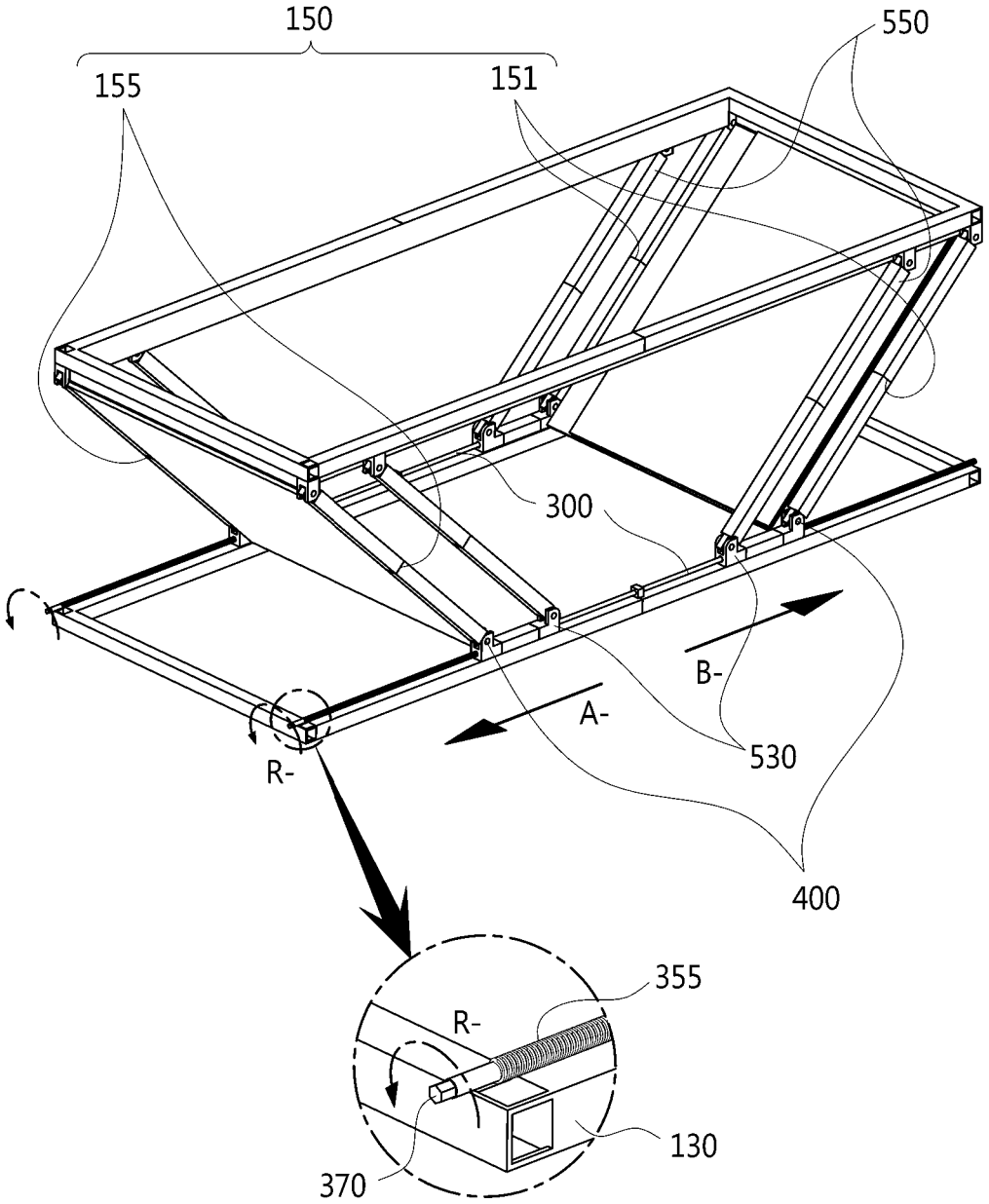

FIGS. 5 to 7 are perspective views for explaining the operation of the cargo container in FIGS. 1 and 2. More specifically, FIGS. 5 and 6 are perspective views for explaining the operation of the cargo container in the folding mode, and FIG. 7 is a perspective view for explaining the operation of the cargo container in the fixing mode.

FIGS. 1 to 7, the cargo container may be operated in a folding mode and a fixing mode.

Before performing the folding mode, the cargo container may perform the following preparatory steps. First, the first side panels 251 fixed to the frame part 100 may be detached by the binding part 700. This process will be omitted when the binding part 700 is not included in the cargo container.

Then, the first side panels 251 may be folded along the plurality of folding lines 270 to be overlaid on the inner side faces of the second side panels 255. After the preparation process is complete, the folding mode of the cargo container may be performed.

As described above, the folding mode and the fixing mode may be controlled according to the rotation direction of the lead screw 300.

In the folding mode, the plurality of lead screws 300 may be rotated in one direction by a user. For example, the lead screws 300 may rotate in an R+ direction.

The rotation of the lead screws 300 in the R+ direction may cause the guide brackets 400, the correction brackets 530 and the connecting members 570 located at both end portions of the lead screw 300 to move linearly in the inward direction toward the lead screw holder 310.

More specifically, when the lead screws 300 are rotated in the R+ direction, the first guide brackets 403 may be moved in a B direction. Herein, the first guide bracket 403, the connecting members 570 and the correction brackets 530 continuously positioned with each other in one direction may be moved together in the B direction.

Accordingly, another end portions of the first side frames 151 connected to the first guide brackets 403 and another end portions of the correction frames 550 connected to the correction brackets 530 may be moved in the B direction substantially in parallel with each other while maintaining the constant distance D2.

When the lead screws 300 are rotated in the R+ direction, the second guide brackets 405 may be moved in an A direction. Herein, the connecting members 570 and the correction brackets 530 continuously positioned with the second guide bracket 405 in another direction, may also be moved together in the A direction. Accordingly, another end portions of the second side frames 155 and another end portions of the correction frames 550 may be moved in the A direction while maintaining a constant interval.

The first side panels 251 and the second side panels 255 may be slidably moved by movement of the first and second side frames 151 and 155 and the correction frames 550. In other words, the lower end portions of the first and second side panels 251 and 255 may be gradually tilted toward the lead screw holder 310 and then laid down. Herein, the descent of the upper frames 110 due to the folding may be continued until the first protruding parts 610 and the second protruding parts 650 are in contact with each other.

When the first protruding parts 610 and the second protruding parts 650 are in contact, the folding of the cargo container may be completed.

In the conventional foldable cargo container, the bottom portion and the side portions are separated and assembled in folding to reduce the volume of the container, thereby resulting in long time and user's troubles.

However, since the cargo container according to an exemplary embodiment of the present invention may be controlled only by the rotation of the lead screws without separation and assembly, it may be possible to improve the convenience of a user, increase the efficiency by reducing the volume, and reduce time and cost.

In the fixing mode, the plurality of lead screws 300 may be rotated in another direction by a user. For example, the lead screws 300 may be rotated in an R− direction.

By rotation of the lead screws 300 in the R− direction, the guide brackets 400 located near the lead screw holder 310 may be linearly moved in an outward direction toward both end portions of the lead screw 300, respectively.

More specifically, when the lead screws 300 are rotated in the R− direction, the first guide brackets 403 may be moved in a B' direction. Herein, the connecting members 570 and the correction brackets 530, which are continuously positioned with the first guide bracket 403 in one direction, may also be moved together in the B' direction. Accordingly, another end portions of the first side frames 151 connected to the first guide brackets 403 and another end portions of the correction frames 550 connected to the correction brackets 530 may be moved in the B' direction while maintaining a constant distance D2.

When the lead screws 300 are rotated in the R− direction, the second guide brackets 405 may be moved in an A' direction. Herein, the connecting members 570 and the correction brackets 530 continuously positioned with the second guide bracket 405 in another direction, may also be moved together in the A' direction. Accordingly, another end portions of the second side frames 155 and another end portions of the correction frames 550 may be moved in the A' direction while maintaining the constant distance D2.

As shown in FIG. 1, the movement of the first and second side frames 151 and 155 and the correction frames 550 may vertically erect the first side panels 251 and the second side panels 255.

Then, the folded first side panels 251 may be unfolded. The unfolded first side panels 251 may be fixed to the frame part 100 again by the binding part 700.

As the above, the cargo container according to an exemplary embodiment of the present invention has been described. The cargo container may be operated in the fixing mode or the folding mode according to loading or unloading cargo by including the frame part, the panel part, the lead screw, the guide bracket, the protruding part and the correcting part. As a result, the volume may be reduced in the folding mode, and the transport with stacked may be available, so that a highly efficient cargo container may be provided that is easy to store and transport.

FIGS. 8 to 12 are views showing a cargo container according to another embodiment of the present invention. The cargo container according to another embodiment of the present invention has substantially the same configuration and operation as those of the cargo container shown in FIGS. 1 to 7 except for a side frame, a guide bracket, a guide panel and a protruding part. Thus, any further description will be omitted.

Figure 8:
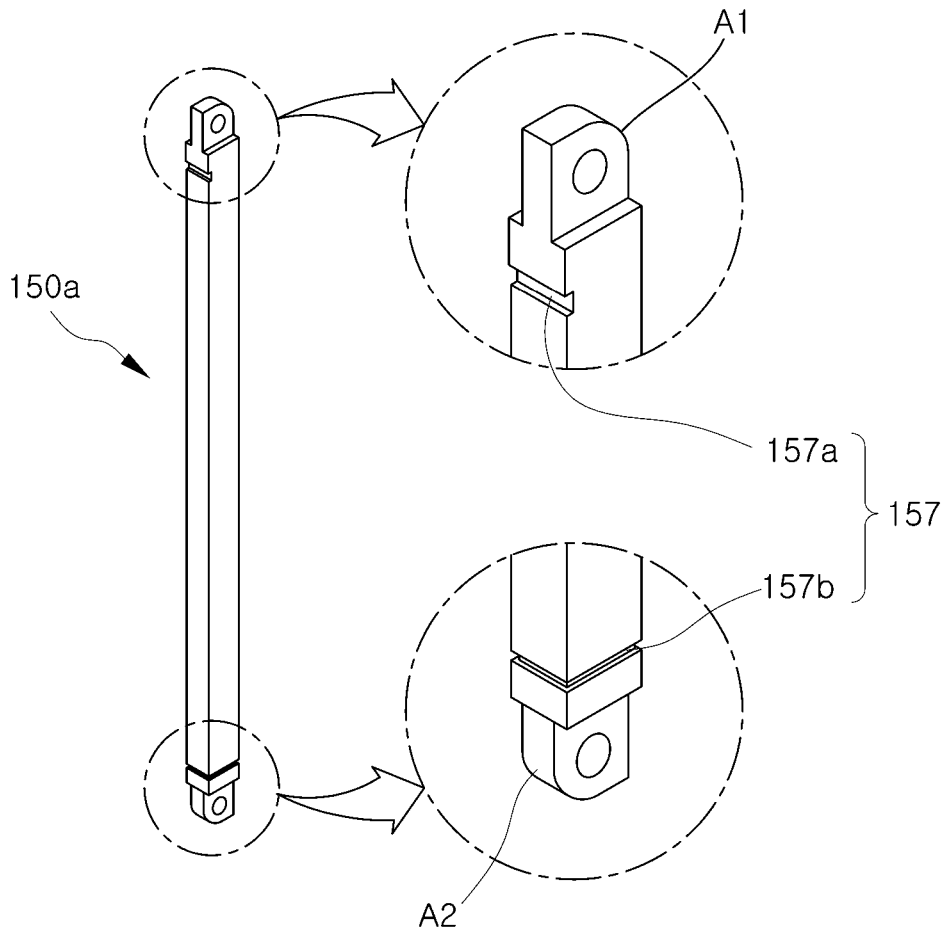
FIG. 8 is a perspective view illustrating side frames of a cargo container according to another exemplary embodiment of the present invention.

FIG. 8 is a perspective view illustrating side frames of a cargo container according to another exemplary embodiment of the present invention.

Referring to FIG. 8, a cargo container according to another embodiment of the present invention includes side frames 150*a* different from the side frames 150 shown in FIGS. 1 to 7. The side frames 150*a* may be positioned at side portions of the frame part 100.

More specifically, one end portions of the side frames 150*a* may be connected to the upper frames 110 by connecting portions 152*a*. In an exemplary embodiment, the connecting portion 152*a* is located at the corner portion of the upper frames 110 and may be provided in a hinge form.

Another end portions of the side frames 150*a* may be connected to the lower frames 130 by guide brackets 400*a*, which will be described later. The guide brackets 400*a* are a configuration that induces the side frames 150*a* to be laid down or stood up according to the operation mode of the cargo container, and may be penetrated by the lead screws 300.

At least portion of end portions of the side frames 150*a* may be provided with a curved face, and for example, the curved face may include a first curved face and a second curved face.

More specifically, the first curved face may be formed in a first area $A_1$ located at one end portion of each side frame 150*a*. The first area $A_1$ may be an area that becomes near to the upper frame 110 in the folding mode.

In addition, the second curved face may be formed in a second area $A_2$ located at another end portion of each side frame 150*a*. The second area $A_2$ may be an area that becomes near to the first lower frame 110 in the folding mode, and may be located in a direction different from the first area $A_1$. In an exemplary embodiment, the second area $A_2$ may be located diagonally to the first area $A_1$.

Accordingly, the cargo container according to an exemplary embodiment of the present invention may be prevented from collision with the upper frames 110 and the lower frames 1310 by the first curved faces and the second curved faces, when the side frames 150*a* move according to the operation mode. Thus, it may be possible to use the cargo container with low damage and long life time.

Meanwhile, the above curved face structure may also be employed in the cargo container in FIGS. 1 to 7.

The side frames 150*a* may include fixing grooves 157. The fixing grooves 157 may be formed on the side frames 150*a* by being recessed to a predetermined depth.

The fixing grooves 157 may fasten the movement of the side frames 150*a* in the fixing mode of the cargo container. The fixing grooves 157 may include first fixing grooves 157*a* and second fixing grooves 157*b*.

The first fixing grooves 157*a* may be formed on one side face of the upper portion of the side frames 150*a*.

When the cargo container is in the fixing mode, the first fixing protrusions described below may be inserted into the first fixing grooves 157*a*. The first fixing protrusions may protrude from one side face of the protruding part 600*a* by a predetermined height corresponding to the recess depth of the first fixing grooves 157*a*.

The first fixing protrusions may be inserted into the first fixing grooves 157*a*, thereby fixing in the substantially vertical direction of the side frames 150*a*. Accordingly, the load concentrated on the connecting portion 152*a* may be dispersed.

The second fixing grooves 157*b* may be formed on at least one lower side face of the side frames 150*a*. The second fixing grooves 157*b* may be provided in plurality.

In an exemplary embodiment, at least one second fixing groove 157*b* may be spaced on the same side face as and apart from the first fixing groove 157*a* by a predetermined distance, and at least one second fixing groove 157*b* may be formed on another side face adjacent to the side face on which the first fixing groove 157*a* is formed.

When the cargo container is in the fixing mode, the second fixing protrusions of guide panels 470 to be described later may be inserted into the second fixing grooves 157*b*, respectively. Accordingly, in the fixing mode, it may be possible to prevent another end portion of the side frames 150*a* from being excessively moved to the outside direction. Also, the load concentrated on the guide brackets 400*a* may be dispersed. Therefore, the cargo container of high strength and high safety may be provided.

In the cargo container according to another embodiment of the present invention, the first and second fixing grooves 157*a* and 157*b*, and the corresponding first fixing protrusion and the corresponding second fixing protrusions may be interchanged.

More specifically, the side frames 150*a* may include a first fixing protrusion protruding from at least one upper side face by a predetermined height, and a second fixing protrusion protruding from at least one lower side face by a predetermined height. Also, the protruding parts 600*a* to be described later may include a first fixing groove recessed corresponding to the first fixing protrusion by a predetermined depth, and the guide panels 470 have a second fixing groove recessed corresponding to the second fixing protrusion by a predetermined depth. In this case, the effect is substantially the same as the effect according to the above-described embodiment, and thus description for the effect will be omitted.

Figure 9:
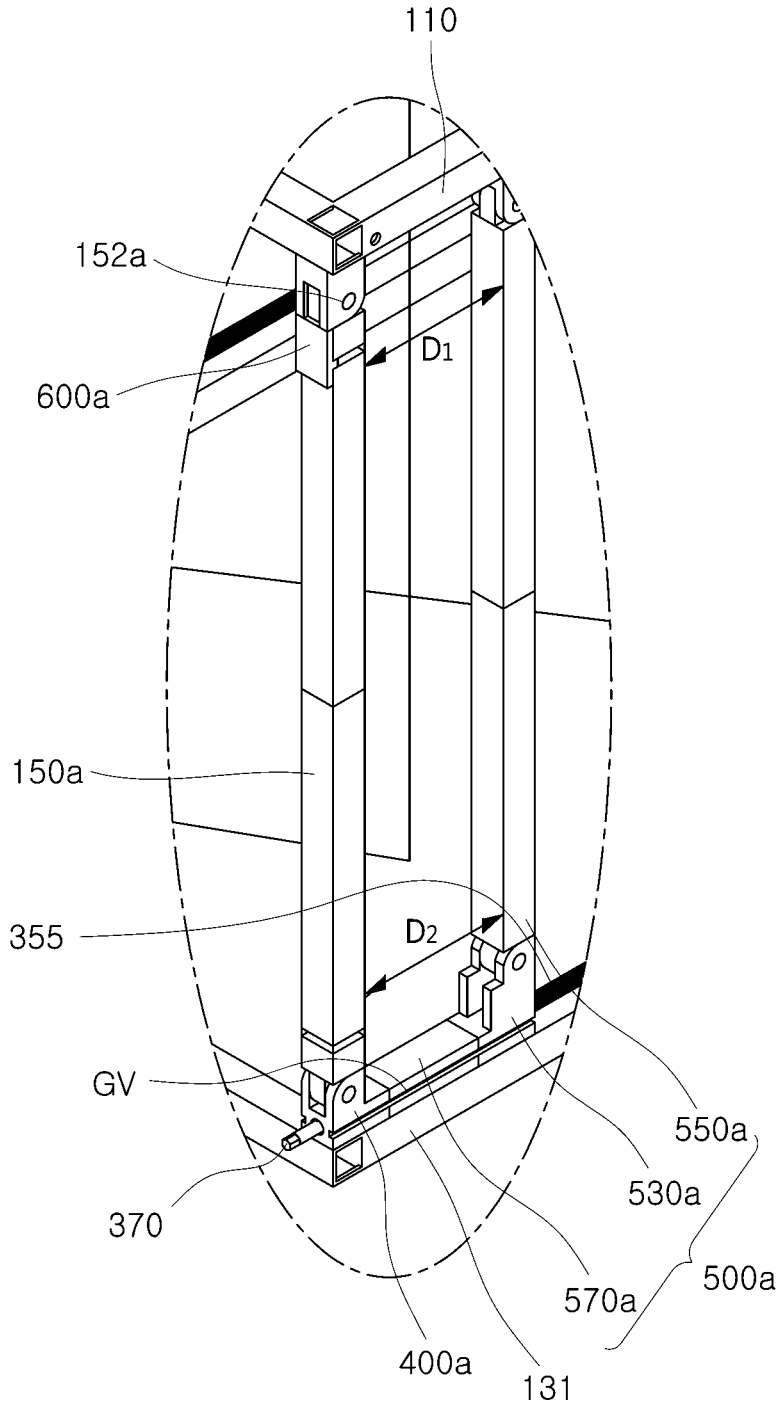
FIGS. 9 and 10 are perspective views for explaining a guide bracket and a correcting part of the cargo container according to another exemplary embodiment of the present invention.
Figure 10:
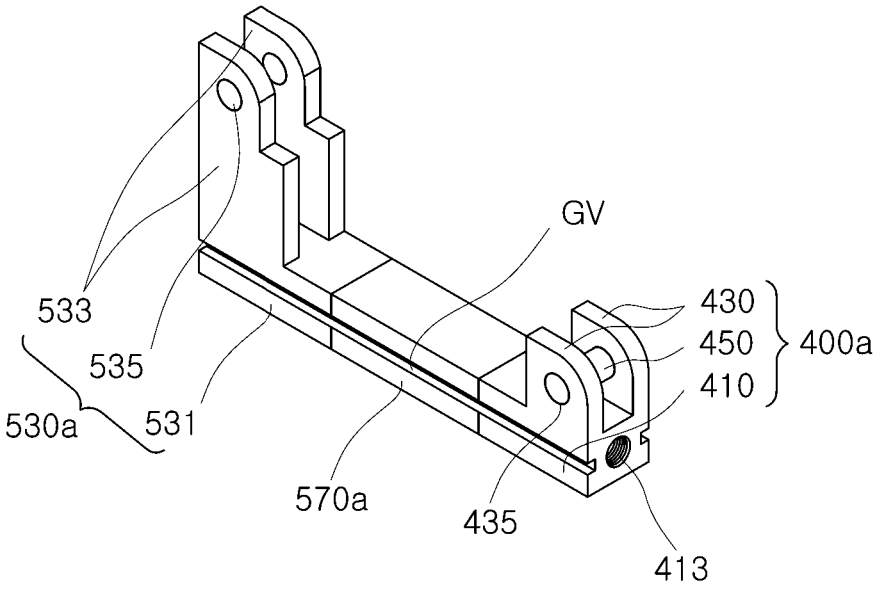

FIGS. 9 and 10 are perspective views for explaining a guide bracket and a correcting part of the cargo container according to another exemplary embodiment of the present invention. More particularly, FIG. 9 is a partially enlarged perspective view of a portion 'A' in FIG. 1, and FIG. 10 is a perspective view illustrating the guide bracket and the correcting part according to another exemplary embodiment. The guide bracket 400*a*, the correcting part 500*a*, and the connecting member 570*a* shown in FIGS. 9 and 10 are substantially the same as the guide bracket 400, the correcting part 500 and the connecting member 570 described in FIG. 4, respectively, except for formation of a guide groove GV, and thus the same reference numerals are used for corresponding configurations, and redundant detailed descriptions are omitted.

Referring to FIGS. 1, 9 and 10, a guide groove GV may be formed on the body 410 of the guide bracket 400*a*, the body 531 of the correction bracket 530*a* of the correcting part 500*a*, and the connecting member 570*a* as shown in FIGS. 9 and 10. The guide groove GV may be recessed by a predetermined depth on the corresponding outer faces of the body 410 of the guide bracket 400*a*, the body 531 of the correction bracket 530*a* of the correcting part 500*a*, and the connecting member 570*a*.

The guide groove GV may be located corresponding to a guide line (475; refer to FIG. 11) describe later. Herein, the guide line 475 may be provided protruding from the inner side face of the guide panel 470 by a predetermined height.

When the lead screw 300 is rotated in accordance with the operating mode, the guide groove GV may be linearly moved along the guide line 475. Accordingly, deviation of the guide bracket 400*a* may be prevented.

Also, the guide groove GV is stuck in the guide line 475 and movement in up and down directions may be restrained. Thus, it may be possible to prevent the lower frame 130 from being separated by the load applied to the lower panel portion in shipment of the cargo container.

Not limited to the above, the positions of the guide groove GV and the guide line 475, which will be described later, may be changed with each other. In other words, in the body 410, the guide line 475 protruding from at least one outer side face by a predetermined height may be formed, and in the guide panel 470, the guide groove GV recessed from an inner side face by a predetermined depth may be formed. Thus, the cargo container may prevent departure of the guide brackets 400*a* and separation of the lower frames 130, as previously described.

Meanwhile, the connecting member 570, as shown in FIGS. 1 to 7, may be provided in a separate independent configuration, or may be provided in such a form that at least one side face thereof is connected to the guide bracket 400*a* or the correction bracket 530*a*.

More specifically, in an exemplary embodiment, the connecting member 570*a* may extend from one end of the correction bracket 530*a* or may extend from one end of the guide bracket 400*a*.

In another exemplary embodiment, as shown in FIG. 10, the connecting member 570*a* may be provided integrally with the guide bracket 400*a* and the correction bracket 530*a*.

The cargo container according to an exemplary embodiment of the present invention may be prevented from leaning in the operation according to the fixing mode and the folding mode by the correcting part 500, thereby providing a cargo container with improved safety.

Figure 11:
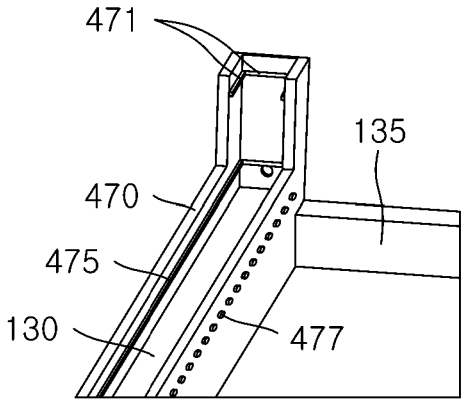
FIGS. 11 and 12 are perspective views illustrating a guide panel according to the guide bracket and the correcting part in FIGS. 9 and 10.
Figure 12:
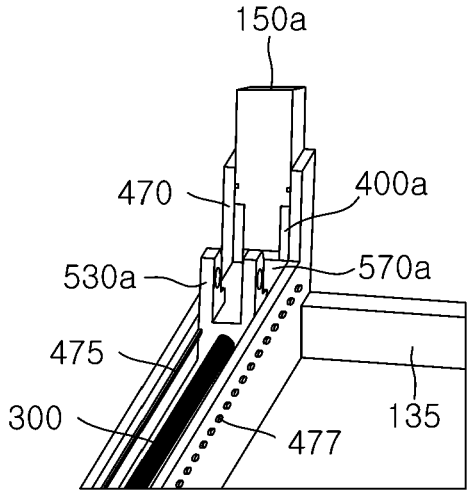

FIGS. 11 and 12 are perspective views illustrating a guide panel according to the guide bracket and the correcting part in FIGS. 9 and 10.

Referring to FIGS. 1, 11 and 12, the guide panel 470 may be formed to surround side face portions of the lower frame 130 to which the lead screw 300 is attached, as described above. More specifically, the guide panels 470 may be formed so as to surround at least portion of the side face of both end portions of the lower frame 130.

Herein, the height of the guide panel 470 may be greater than the height of the guide bracket 400*a* and the correction bracket 530*a* located on the lead screw 300. Accordingly, the guide panel 470 may prevent the guide bracket 400*a* and the correction bracket 530*a* from being separated due to an external impact.

The guide panel 470 may include a second fixing protrusion 471 and a guide line 475.

The second fixing protrusion 471 may protrude from the inner side face of the guide panel 470 by a predetermined height as described above. The second fixing protrusion 471 may be formed in plurality at a position corresponding to the second fixing groove 157*b* (refer to FIG. 8), so that another end portions of the side frames 150 may be fixed.

Since the features of the second fixing protrusion 471 are substantially the same as those described in the description of the second fixing groove 157*b*, detailed description will be omitted.

The guide line 475 may be provided protruding from the inner side face of the guide panel 470 by a predetermined height, as described above.

The guide line 475 may guide movement of the guide bracket 400*a*, the correction bracket 530*a* and the connecting member 570*a*.

More specifically, the guide groove GV formed on the guide bracket 400*a*, the correction bracket 530*a*, and the connecting member 570*a* may be positioned on the guide line 475 as described above. In other words, the guide groove GV may be provided fitted on the guide line 475. Accordingly, the guide groove GV is linearly moved in the forward and backward directions along the guide line 475 when the lead screw 300 rotates, thereby preventing the configurations 400*a*, 530*a*, and 570*a* from being separated from the external impact.

The position of the guide line 475 may be interchanged with the position of the guide groove GV, as in the embodiments described above in the description of the guide bracket 400*a*. Accordingly, when the guide lines 475 are formed on the guide brackets 400*a*, the correction frames 530*a* and the connecting members 570*a*, the guide groove 470 may be formed on the guide panel 470.

The guide panel 470 may further include a plurality of perforation holes 477. The perforation holes 477 may be formed in holes with a predetermined width.

More specifically, the perforation holes 477 may be formed at a position where at least portion of the perforation holes 477 is in contact with the side panel portion 250 in the fixing mode of the cargo container. The screws may be fastened to the perforation holes 477 to fix the movement of the side panel portion 251. Accordingly, folding of the side panel portions 251 due to an external impact may be prevented. Also, as with the guide groove GV described above, it may be possible to prevent the lower frame 130 from being separated by the load applied to the lower panel portion in shipment of the cargo container.

Figure 13:
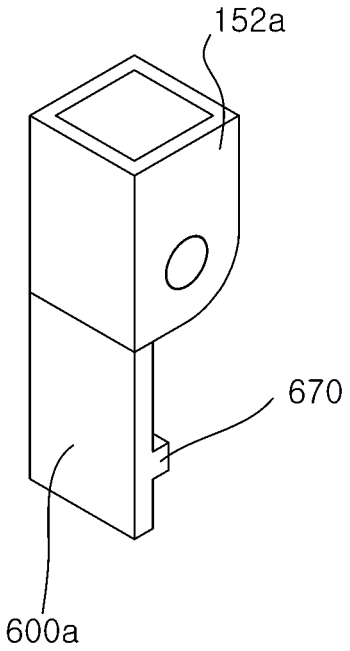
FIG. 13 is a perspective view illustrating another example of the protruding part of the cargo container shown in FIG. 1.

FIG. 13 is a perspective view illustrating another example of the protruding part of the cargo container shown in FIG. 1.

Referring to FIGS. 1 and 13, the protruding part 600*a* may be provided in plurality, and may downwardly protrude from the corner portions of the upper frames 110 by a predetermined length. More specifically, the protruding parts 600*a* may downwardly protrude from the bottom of the connection part 152*a* fixed to the upper frame 110 by a predetermined length.

The protruding parts 600*a* may be positioned on substantially the same vertical line as at least a portion of the guide panel 470. In the folding mode of the cargo container, the lower faces of the protruding parts 600*a* and the upper faces of the guide panel 470 may contact each other at a predetermined height. Accordingly, in the folding mode, movement of the side frames 150 that inwardly slides may be restrained.

Thus, the cargo container according to an exemplary embodiment of the present invention reduces the collision between frames in the frame part 100 in the folding mode, so that a long life time thereof may be available.

Also, the protruding parts 600*a* may include a first fixing protrusion 670. The first fixing protrusion 670 may protrude from the inner side face of the protruding part 600*a* by a predetermined height, as described above.

The first fixing protrusion 670 may be inserted into the first fixing groove 157*a* in the fixed mode of the cargo container. Accordingly, the first fixing protrusion 670 may prevent one side of the side frames 150 from being tilted by more than 90 degrees due to excessive movement of another side of the side frames 150.

Figure 14:
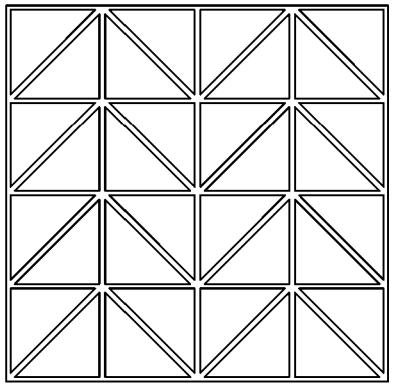
FIGS. 14 and 15 are plan views illustrating exemplary embodiments of the panel part of the cargo container in FIG. 1.
Figure 15:
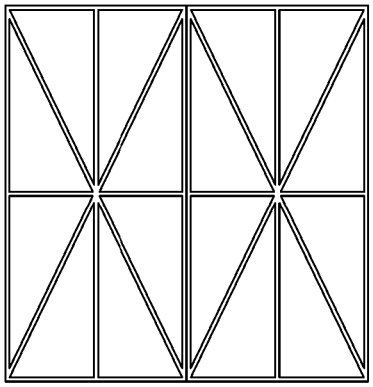

FIGS. 14 and 15 are plan views illustrating exemplary embodiments of the panel part of the cargo container in FIG. 1. More specifically, FIG. 14 is a plan view showing the panel part having a truss pattern structure, and FIG. 15 is a plan view showing the panel part having a rib pattern structure.

Referring to FIGS. 1, 14 and 15, at least one face of the side panel portion 250 may be provided in a patterned structure. More specifically, at least one area of the first side panels 251 or at least one area of the second side panels 255 may be provided in the pattern structure. For example, the pattern structure may be a truss structure shown in FIG. 14 or a rib structure shown in FIG. 15.

The pattern structure may disperse the impact externally applied to the side panel portion 250. Thus, the cargo container according to an exemplary embodiment of the present invention may be reinforced in strength by the pattern structure.

The pattern structure is not limited to the side panel portion 250 described above, but may also be formed on the upper panel portion or the lower panel portion.

As described above, the cargo container according to an exemplary embodiment of the present invention further includes a pattern structure of the panel part for improving durability, a side frame fixing structure with the protruding part and the guide panel, and a detachment prevention structure with the guide bracket and the fixing bracket, thereby reducing impact in the operation mode and dispersing the loads concentrated on the connection portions of the respective frame portions, to provide a highly reliable cargo container which may be used for a long life time.

Figure 16:
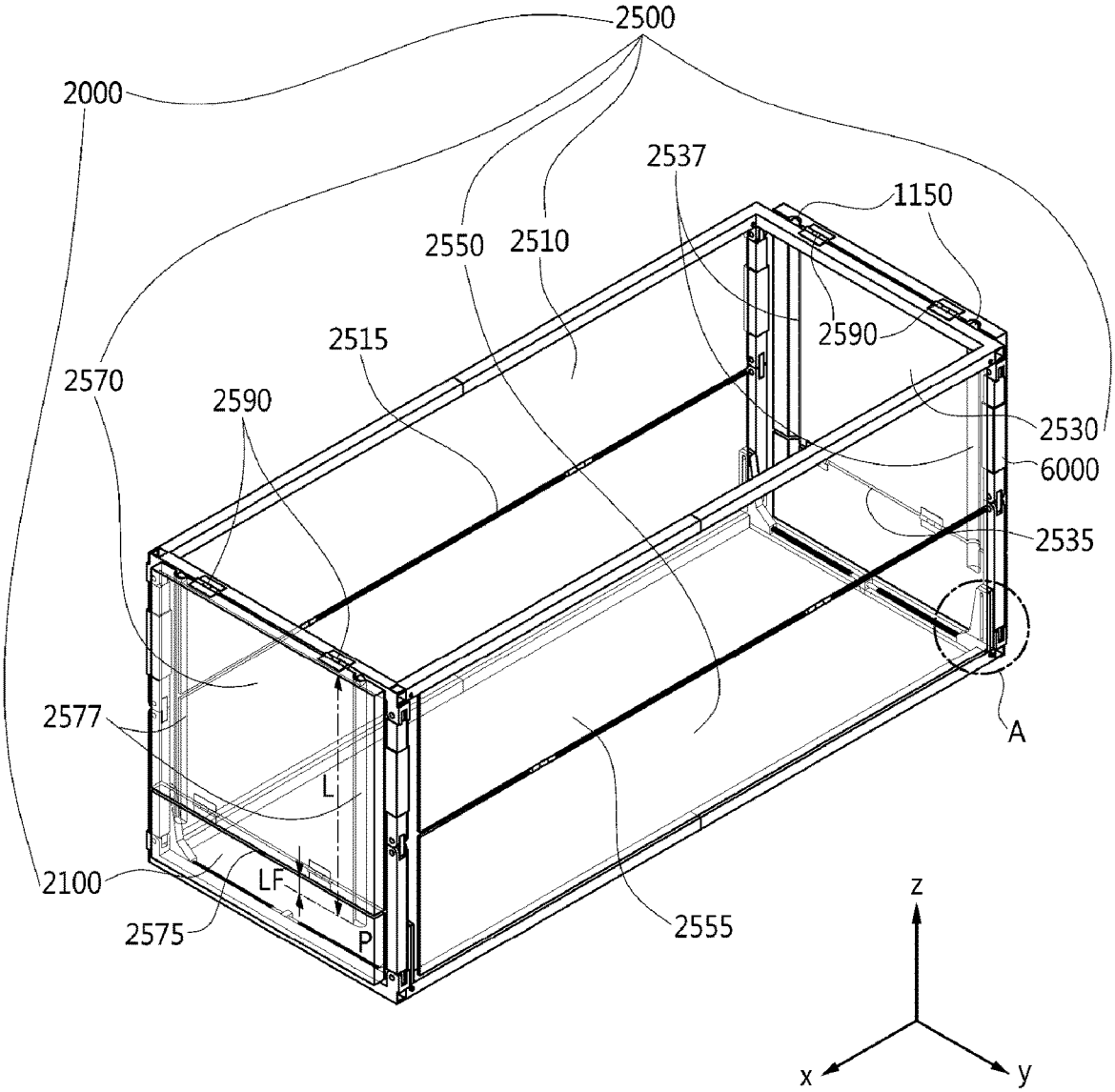
FIGS. 16 and 17 are perspective views illustrating a cargo container according to still another exemplary embodiment of the present invention.
Figure 17:
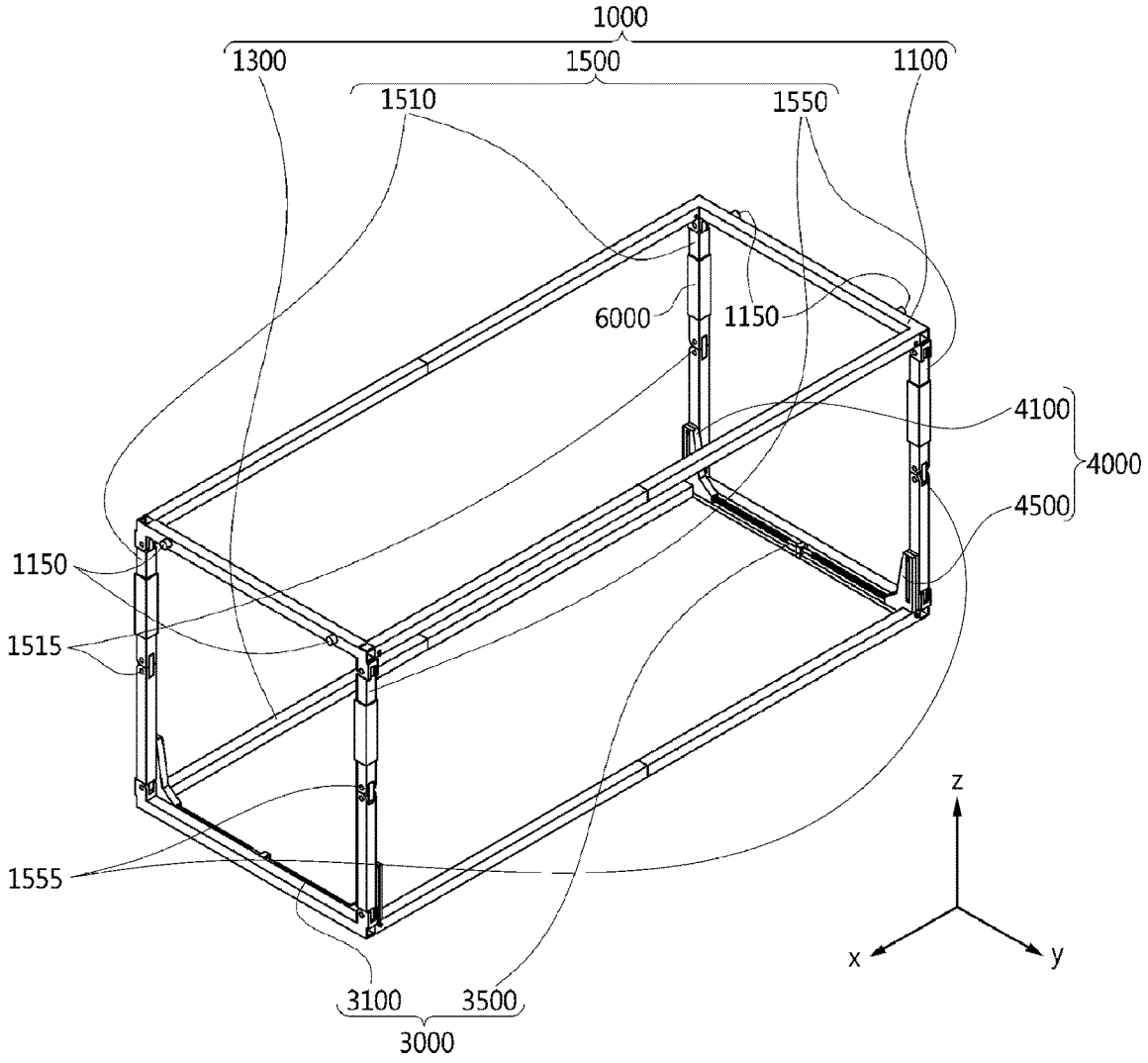

FIGS. 16 and 17 are perspective views illustrating a cargo container according to still another exemplary embodiment of the present invention. More particularly, FIG. 16 is a perspective view of the cargo container, and FIG. 17 is a perspective view for explaining the configurations of the cargo container, with the panel part removed for convenience.

Referring to FIGS. 16 and 17, the cargo container may include a frame part 1000, a panel part 2000, a lead screw 3000, a guide bracket 4000, a protruding part 5000, and a fixing bracket 6000.

The frame part 1000 is a framework of the cargo container, which may be a hexahedral shape. The frame part 1000 may include upper frames 1100, lower frames 1300, and side frames 1500.

The upper frames 1100 may be located at the top of the frame part 1000. In an exemplary embodiment, a plurality of upper frames 1100 may be provided in a form of a rectangular frame.

A correction protruding portion 1150 may be attached to the outer side faces of a pair of upper frames 1100 facing each other at front and rear. The correction protruding portion 1150 may protrude by a predetermined length.

The correction protruding portion 1150 may be inserted into the correction guide groove 2537 and 2577 to be described later. When the cargo container is in the folding mode, the correction protruding portion 1150 may be downwardly moved along the correction guide grooves 2537 and 2577. Accordingly, the upper frames 1100 may descend in a balanced manner while being kept substantially horizontal.

The lower frames 1300 may be located at the bottom of the frame part 1000. In other words, the lower frames 1300 may be spaced apart from the upper frames 1100 in the −z axis direction by a predetermined distance. In an exemplary embodiment, the lower frames 1300 may be provided in substantially the same rectangular form as the upper frames 1100.

The lead screw 3000, which will be described later, may be attached to the inner side faces of a pair of lower frames 1300 facing each other at front and rear. The lead screw 3000 will be described in more detail below.

The side frames 1500 may be located on the side of the frame part 1000. More specifically, one end portions of the side frames 1500 may be connected to the upper frames 1100, and another end portions of the side frames 1500 may be connected to the lower frames 1300.

The side frames 1500 may be divided into a first side frame part 1510 and a second side frame part 1550 according to the direction in which the side frames 1500 are folded in the folding mode. The first side frame portion 1510 may include a pair of frames spaced apart from each other at a first side by a predetermined interval.

First frame folding lines 1515 may be formed at the central portion of the first side frame portion 1510. Accordingly, the first side frame portion 1510 may be folded in the +y axis direction with respect to the first frame folding lines 1515 in the folding mode.

The second side frame portion 1550 may include a pair of frames spaced apart from each other at a second side by a predetermined interval. Second frame folding lines 1555 may be formed at the central portion of the second side frame portion 1550. Accordingly, the second side frame portion 1550 may be folded in the −y axis direction with respect to the second frame folding lines 1555 in the folding mode.

The panel part 2000 may be placed on the faces defined by the frame part 1000. The panel part 2000 may be provided in a form of a plate.

The panel part 2000 may include a lower panel 2100 and a plurality of side panels 2500. In addition, the panel part 2000 may further include an upper panel (not shown), depending on the needs of a user. The function and effect of the upper panel are easily deduced from those skilled in the art, so a detailed description thereof will be omitted.

The lower panel 2100 may be attached on a face defined by the lower frames 1300.

The side panels 2500 may be located on a plurality of faces defined by the upper frame 1100, the lower frame 1300, and the side frames 1500.

The side panels 2500 may include first, second, third and fourth side panels 2510, 2530, 2550 and 2570. The first side panel 2510 and the third side panel 2550 may be attached to the frame part 1000.

The first and third side panels 2510 and 2550 may be formed with first panel folding lines 2515 and 2555 at the central portion. In other words, the first panel folding lines 2515 and 2555 may be provided at substantially the same height as the first and second frame folding lines 1515 and 1555. Accordingly, in the folding mode of the cargo container, the first and third side panels 2510 and 2550 may be folded in the inner direction simultaneously along the first and second side frame portions 1510 and 1550.

More particularly, the first side panel 2510 may be downwardly folded while the first panel folding line 2515 is moved in the +y axis direction, and the third side panel 2550 may be downwardly folded while the first panel folding line 2555 is moved in the −y axis direction, The second and fourth side panels 2530 and 2570 may be formed with second panel folding lines 2535 and 2575 at the central portion. The second panel folding lines 2535 and 2575 may be formed corresponding to the location of the descended upper frames 1100 when the cargo container has been folded by the folding mode.

Thus, in the folding mode of the cargo container, the second and fourth side panels 2530 and 2570 may be inwardly folded simultaneously by the second panel folding lines 2535 and 2575, respectively.

More specifically, the second side panel 2530 may be folded in the −x axis direction with respect to the second panel folding line 2535, and the fourth side panel 2570 may be folded in the +x axis direction with respect to the second panel folding line 2575.

The correction guide grooves 2537 and 2577 may be formed on the surfaces of the second and fourth side panels 2530 and 2570.

The correction guide grooves 2537 and 2577 may be provided as a groove having a predetermined width. The width of the groove may correspond to the diameter of the correction protruding portion 1500. Accordingly, in the descent of the upper frames 1100 according to the folding mode, at least portion of the correction protruding portion 1500 may be inserted into the correction guide grooves 2537 and 2577 and be stably moved downward.

The groove may be provided with a predetermined length L from the top of the second and fourth side panels 2530 and 2570 through the second panel folding lines 2535 and 2575. More specifically, the length L of the groove may be formed from the top of the second and fourth side panels 2530 and 2570 to the point P based on the z axis. Herein, the distance $L_F$ between the second panel folding lines 2535 and 2575 and the point P may correspond to the height of the upper frames 1100. Thus, in the folding mode, the top of the descended upper frames 1100 may be positioned on substantially the horizontal line with respect to the second panel folding lines 2535 and 2575. Thus, the second and fourth side panels 2530 and 2570 may be inwardly folded by the second panel folding lines 2535 and 2575.

The cargo container according to an exemplary embodiment of the present invention may be prevented from leaning when performing the operations of the fixing mode and the folding mode by the correction guide grooves 2537 and 2577 and the correction protruding portion 1150, thereby improving stability.

Based on the second panel folding lines 2535 and 2575, the upper side faces of the second side panel 2530 and the fourth side panel 2570 may be detachable from the frame part 1000. More specifically, the second side panel 2530 and the fourth side panel 2570 may include a plurality of binding parts 2590. Accordingly, the upper side faces of the second side panel 2530 and the fourth side panel 2570 may be detached from the frame part 1100.

When the cargo container is operated in the folding mode, the second side panel 2530 and the fourth side panel 2570 may be detached from the frame part 1100 to be open by the plurality of binding parts 2590.

In another exemplary embodiment, when the cargo container is operated in the fixing mode, the second side panel 2530 and the fourth side panel 2570 may be fixedly attached to the frame part 1100 by the plurality of binding parts 2590.

The operations according to the folding mode and the fixing mode of the cargo container will be described in more detail in FIGS. 22 to 24, which will be described later.

Figure 18:
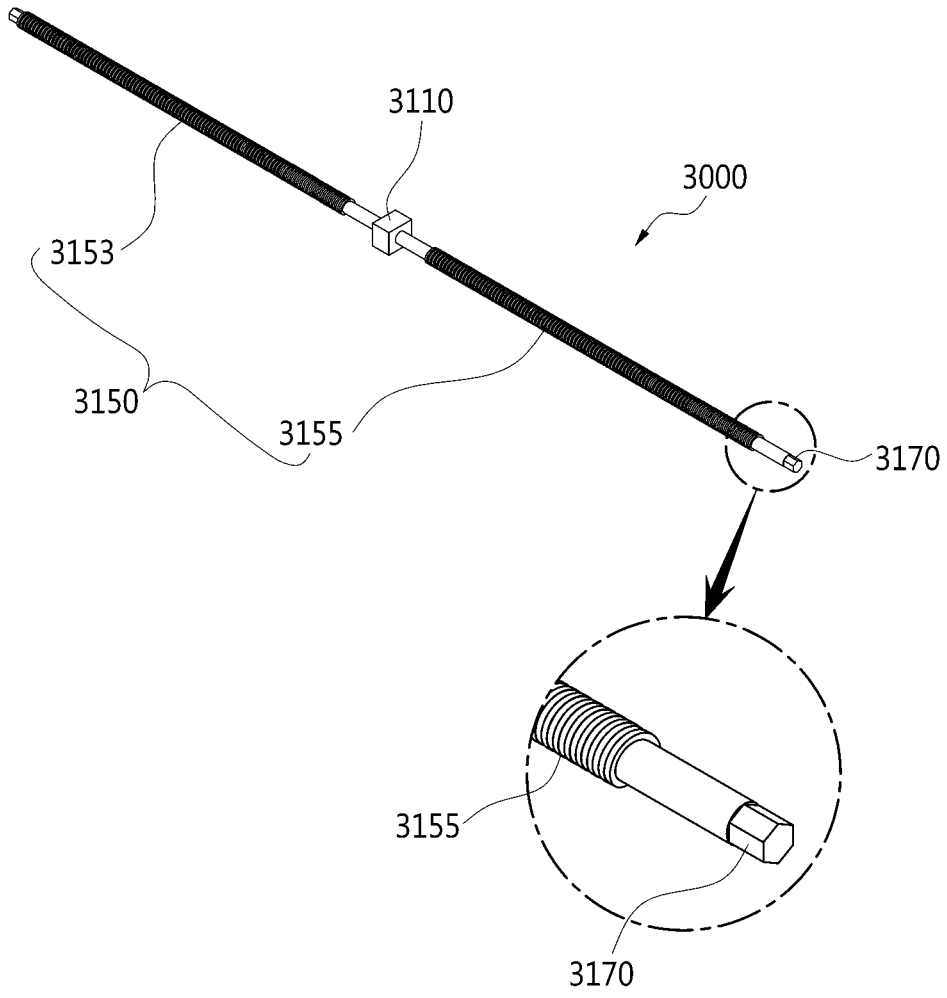
FIG. 18 is a perspective view illustrating a lead screw of the cargo container in FIGS. 16 and 17.

FIG. 18 is a perspective view illustrating a lead screw of the cargo container in FIGS. 16 and 17.

Referring to FIGS. 16 to 18, the lead screw 3000 may be provided in a rod shape having a predetermined length.

The lead screw 3000 may be provided in plurality. A plurality of lead screws 3000 may be located on the inner side faces of the lower frames 1300, facing each other at front and rear.

More specifically, the lead screw 3000 may include a first lead screw 3100 and a second lead screw 3500. The first lead screw 3100 may be located on the inner side face of the lower frame 1300 located at the front. In addition, the second lead screw 3500 may be located on the inner side face of the lower frame 1300 located at the rear.

Each of the first and second lead screws 3100 and 3500 may include a lead screw holder 3110, a screw region 3150, and a handle portion 3170.

The lead screw holder 3110 may be positioned through a central portion of the first and second lead screws 3100 and 3500, respectively.

The lead screw holder 3110 may fix the first and second lead screws 3100 and 3500 to the inner side face of the lower frame 1300.

The screw region 3150 may be formed on the surfaces of the first and second lead screws 3100 and 3500, respectively, and may include a plurality of screw threads having directionality. More specifically, the screw region 3150 may include a first screw region 3153 and a second screw region 3155.

The first screw region 3153 may be formed at one side with respect to the lead screw holder 3110. In the first screw region 3153, a screw thread protruding in a first direction may be formed.

The second screw region 3155 may be formed at another side of the lead screw holder 3110. In the second screw region 3155, a screw thread protruding in a second direction opposite to the first direction may be formed.

In other words, the first and second lead screws 3100 and 3500 may have screw threads that are opposite in direction to each other with respect to the lead screw holder 3110 in the first screw region 3153 and the second screw region 3155, respectively. Accordingly, in a rotating operation of the first and second lead screws 3100 and 3500 by the folding mode or the fixing mode, a plurality of guide brackets 4000, which will be described later, positioned at both end portions of the first and second lead screws 3100 and 3500, approach the lead screw holder 3110, or move away from the screw holder 3110, The handle portion 3170 may be a handle provided to a user to rotate the first and second lead screws 3100 and 3500. In an exemplary embodiment, a user may control the operation mode of the cargo container by rotating the handle portion 3170 in a clockwise or counterclockwise direction. In other words, depending on the rotation direction of the handle portion 3170, the cargo container may be operated in the folding mode or the fixing mode.

Figure 19:
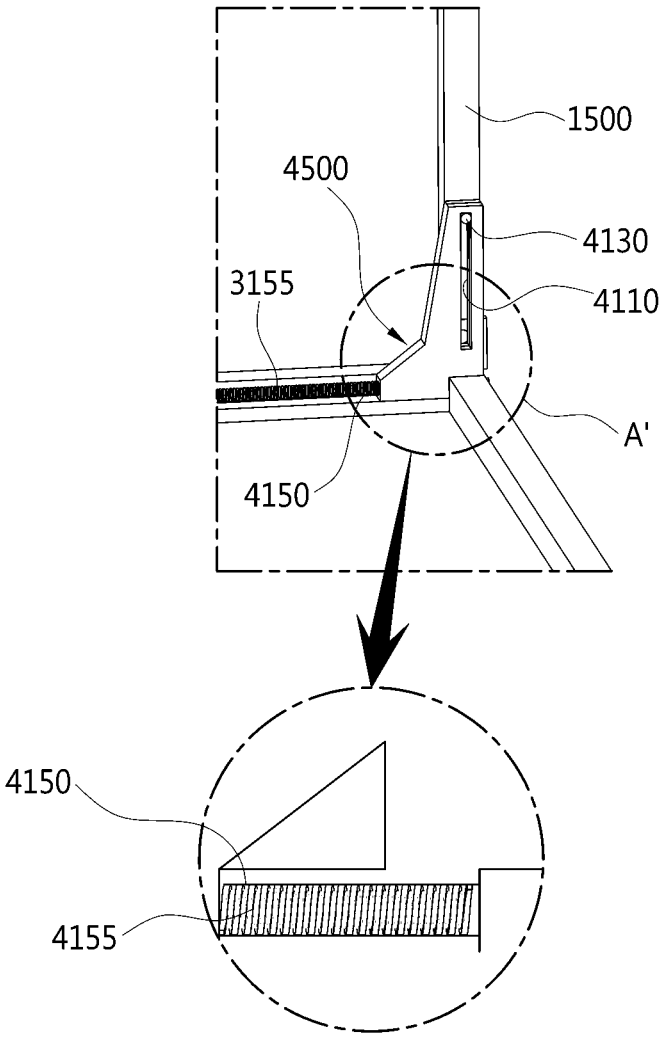
FIG. 19 is a partially enlarged perspective view of a portion 'A' in FIG. 16 to explain the guide bracket of the cargo container in FIGS. 16 and 17.

FIG. 19 is a partially enlarged perspective view of a portion 'A' in FIG. 16 to explain the guide bracket of the cargo container in FIGS. 16 and 17.

Referring to FIGS. 16 to 19, the guide bracket 4000 may be provided in plurality to guide folding or unfolding of the first and second side frame portions 1510 and 1550.

The plurality of guide brackets 4000 may include first guide brackets 4100 positioned through one end portions of the first and second lead screws 3100 and 3500, and second guide brackets 4500 positioned through another end portions of the first and second lead screws 3100.

Each of the first and second guide brackets 4100 and 4500 may include a guide road 4110, a guide pin 4130 and a screw hole 4150.

The guide road 4110 may be formed by opening a predetermined length on the surfaces of the first and second guide brackets 4100 and 4500.

In another exemplary embodiments, the guide road 4110 may be provided in a form of a groove having a predetermined length on another faces of the first and second guide brackets 4100 and 4500.

The guide pin 4130 may protrude, by a predetermined length, from the inner side face of the lower end portions of the first and second frame folding lines 1515 and 1555 of the first and second side frame parts 1510 and 1550. The guide pin 4130 may be formed corresponding to at least one point facing the guide road 4110.

At least a portion of the guide pin 4130 may be inserted into the guide road 4110 to perform reciprocating linear motion along the guide road 4110. In an exemplary embodiment, when the guide pin 4130 is upwardly or downwardly moved along the guide road 4110, the first and second side frame parts 1510 and 1550 connected to the guide pin 4130 may be folded or erected.

The screw hole 4150 may be formed through the side face portions of the first and second guide brackets 4100 and 4500.

The screw hole 4150 may be a space into which the first and second lead screws 3100 and 3500 are inserted. Referring to seeing through the portion 'A' of FIG. 19, a screw groove 4155 having a directionality may be formed in the screw hole 4150. The screw groove 4155 may be formed in a shape corresponding to the protruding screw threads of the screw region 3150.

More specifically, the screw groove 4155 of the first guide brackets 4100 may be formed in a shape corresponding to the screw thread protruding in the first direction of the first screw region 3151. In addition, the screw guide 4155 of the second guide bracket 4500 may be formed in a shape corresponding to the screw thread protruding in the second direction of the second screw region 3155. Accordingly, in the rotation of the first and second lead screws 3100 and 3500, the first and second guide brackets 4100 and 4500 may be stably linearly moved along the associated screw groove 4155.

Figure 20:
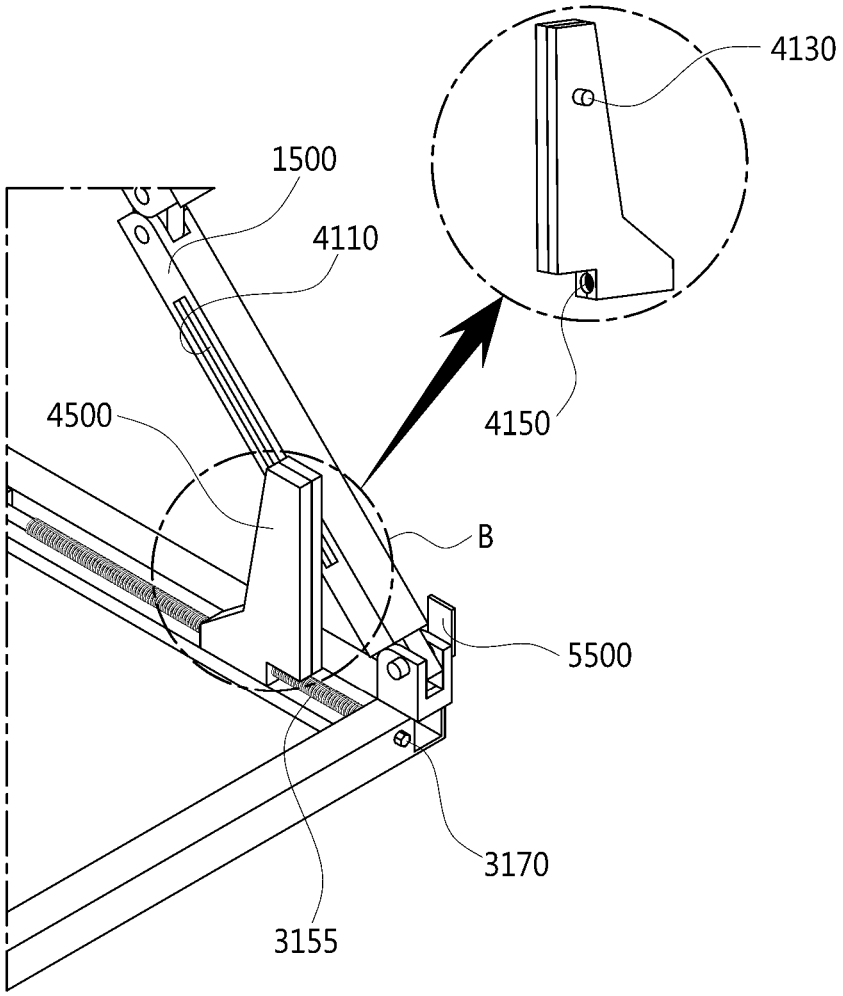
FIG. 20 is a partial perspective view illustrating a guide bracket of the cargo container in FIGS. 16 and 17.

FIG. 20 is a partial perspective view illustrating a guide bracket of the cargo container in FIGS. 16 and 17.

Referring to FIGS. 16 to 18 and 20, the guide bracket 4000 may be provided in plurality to guide folding or unfolding of the first and second side frame portions 1510 and 1550.

The plurality of guide brackets 4000 may include first guide brackets 4100 positioned through one end portion of the first and second lead screws 3100 and 3500, and second guide brackets 4500 positioned through another end portion of the first and second lead screws 3100.

Each of the first and second guide brackets 4100 and 4500 may include a guide road 4110, a guide pin 4130 and a screw hole 4150.

The guide road 4110 may be formed by opening a predetermined length on the lower inner side face of the first and second side frame portions 1510 and 1550 located below the first and second frame folding lines 1515 and 1555.

A portion 'B' in FIG. 20 is a partial perspective view showing another face of the second guide bracket 4500. Referring to the portion 'B', the guide pin 4130 may protrude from another side of the first and second guide brackets 4100 and 4500 by a predetermined length. Herein, the guide pin 4130 may be formed corresponding to at least one point facing the guide road 4110. Accordingly, at least a portion of the guide pin 4130 may be inserted into the guide road 4110 to perform reciprocating linear motion along the guide road 4110.

The screw hole 4150 may be a space into which the first and second lead screws 3100 and 3500 are inserted.

The screw hole 4150 may be formed through the side face portions of the first and second guide brackets 4100 and 4500. The screw groove 4155 may be formed in a shape corresponding to the screw threads of the screw region 3150, as described with reference to FIG. 19. Accordingly, the first and second guide brackets 4100 and 4500 may be stably linearly moved along the screw groove 4155 when rotating the first and second lead screws 3100 and 3500, respectively.

Figure 21:
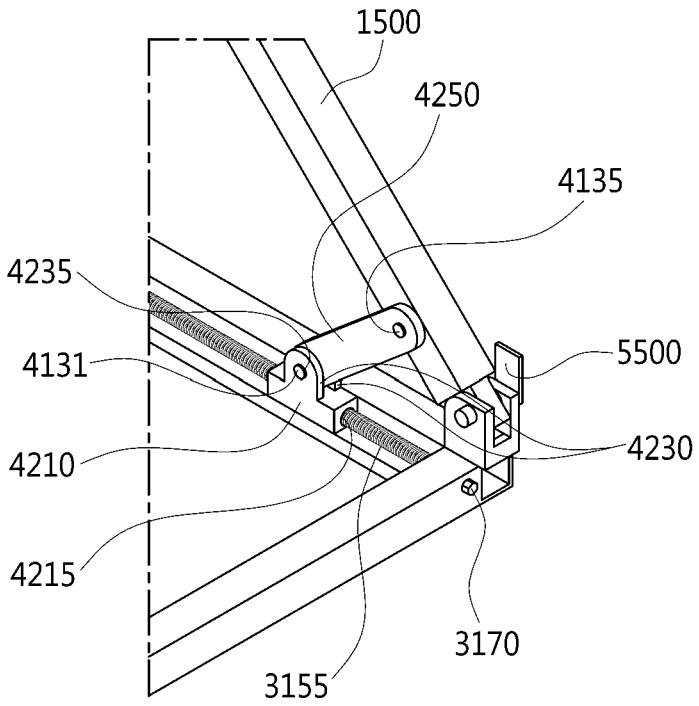
FIG. 21 is a partial perspective view illustrating another example of the guide bracket of the cargo container in FIGS. 16 and 17.

FIG. 21 is a partial perspective view illustrating another example of the guide bracket of the cargo container in FIGS. 16 and 17.

Referring to FIGS. 16 to 18 and 21, the guide bracket 4000 may be positioned at and penetrated through both end portions of the lead screw 3000.

The guide bracket 4000 may convert a rotational motion of the lead screw 3000 into a linear motion.

The guide bracket 4000 may include a body 4210, sidewalls 4230 and a connecting rod 4250.

A first through-hole 4215 may be formed through the body 4210. The first through-hole 4215 may be formed through the side face portion of the body 4210. In other words, the first through-hole 4215 may be formed through the body 4210 in the y axis direction.

The first and second lead screws 3100 and 3500 may be located inside the first through-hole 4215.

The inner surface of the first through-hole 4215 may be formed with a helical screw groove (not shown) substantially parallel to one direction or another direction. The screw groove may correspond to the screw groove 4155 described with reference to FIG. 19. In other words, the screw groove may be shaped to correspond to the protruding screw threads of the screw region 3150 on the lead screws 3100 and 3500. Accordingly, the lead screw 4000 may be stably rotated along the screw groove.

The sidewalls 4230 may be formed to protrude from the body 4210 in the +z axis direction by a predetermined height.

The sidewalls 4230 may be formed with a predetermined spacing based on x axis. Between the sidewalls 4230, the connecting rod 4250, described below, may be located.

Second through-holes 4235 may be formed in the sidewalls 4230, respectively. More specifically, the second through-holes 4235 having a predetermined diameter on the basis of x axis may be formed through the sidewalls 4230.

The second through-holes 4235 may be pierced with a first guide pin 4131. In other words, the first guide pin 4131 may be fixed through the sidewalls 4230 in which the connecting rod 4250 is located.

The connecting rod 4250 may be provided in a form of a rod having a predetermined length. The connecting rod 4250 may connect the guide bracket 4000 and the side frame 1500.

More specifically, one end portion of the connecting rod 4250 may be connected to the sidewalls 4230 by the first guide pin 4131, as described above. In addition, another end portion of the connecting rod 4250 may be connected to the side frames 1500 by a second guide pin 4135 formed by protruding a predetermined distance from the side frame 1500. In an exemplary embodiment, the second guide pin 4135 may be connected to another end portion of the connecting rod 4250. Accordingly, the lead screw 3000, the guide bracket 4000 and the side frame 1500 are connected, so that the guide screw 3000 and the side frame 1500 may be continuously operated by the operation of the lead screw 3000. More specifically, in the folding mode or the fixing mode of the cargo container in which the lead screw 3000 is rotated, the side frames 1500 may be folded or erected in accordance with the linear movement of the guide brackets 4000.

Figure 23:
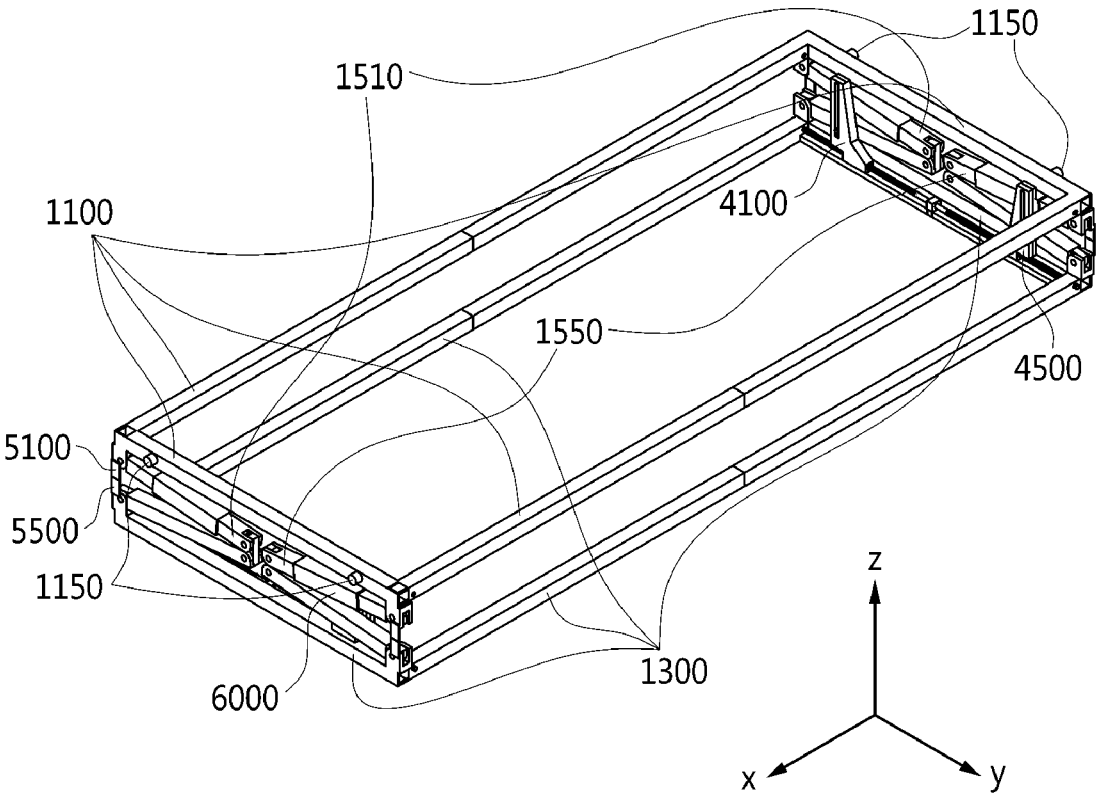

Referring to FIG. 23, which will be described later, the protruding part 5000 may be provided in a rod shape having a predetermined length. The protruding part 5000 may include first protruding parts 5100 and second protruding parts 5500.

The first protruding parts 5100 are provided in plurality and may be individually attached to the corner portions of the upper frames 1100, respectively. In an exemplary embodiment, the first protruding parts 5100 may be attached to the bottom of the corner portion of the upper frame 1100 and protrude by a predetermined length in the −z axis direction.

The second protruding parts 5500 are provided in plurality and may be individually attached to the corner portions of the lower frames 1300. In the exemplary embodiment, the second protruding parts 5500 may be attached to the top of the corner portion of the lower frame 1300 and protrude by a predetermined length in the +z axis direction. The second protruding parts 5500 may be positioned on substantially the same axis as the first protruding parts 5100, respectively.

The first and second protruding parts 5100 and 5500 may restrict the folding of the side frame 1500 in the folding mode of the cargo container. More specifically, in the folding mode, the upper frames 1100 may be descended by folding the side frames 1500 of the cargo container.

The first protruding parts 5100 formed in the descending upper frames 1100 may contact with the second protruding parts 5500 of the lower frame 1300 at a predetermined height. Accordingly, the descent of the upper frames 1100 may be restricted by the first and second protruding parts 5100 and 5500.

The conventional foldable containers does not teach a configuration for improving durability, and thus may cause damage to the container during the folding of the side portion for reducing the volume thereof.

In contrast, the cargo container according to an exemplary embodiment of the present invention may absorb impact of the frame part in the folding mode by a plurality of protruding parts. Accordingly, a highly reliable cargo container that may be used for a long time may be provided.

Referring again to FIGS. 16 and 17, the fixing bracket 6000 is provided in plurality and may be provided in a pipe shape having a predetermined length.

The fixing bracket 6000 may be moved along the surface of the side frames 1500 by a predetermined distance. In an exemplary embodiment, in the fixing mode of the cargo container, the fixing bracket 6000 may be positioned at the portion where the first and second frame folding lines 1515 and 1555 are formed. Accordingly, folding of the side frame 1500 due to an external impact may be prevented.

In addition, in the folding mode of the cargo container, the fixed bracket 6000 may be upwardly or downwardly moved with respect to the first and second frame folding lines 1515 and 1555. Accordingly, the side frames 1500 may be inwardly folded along the first and second frame folding lines 1515 and 1555.

Figure 22:
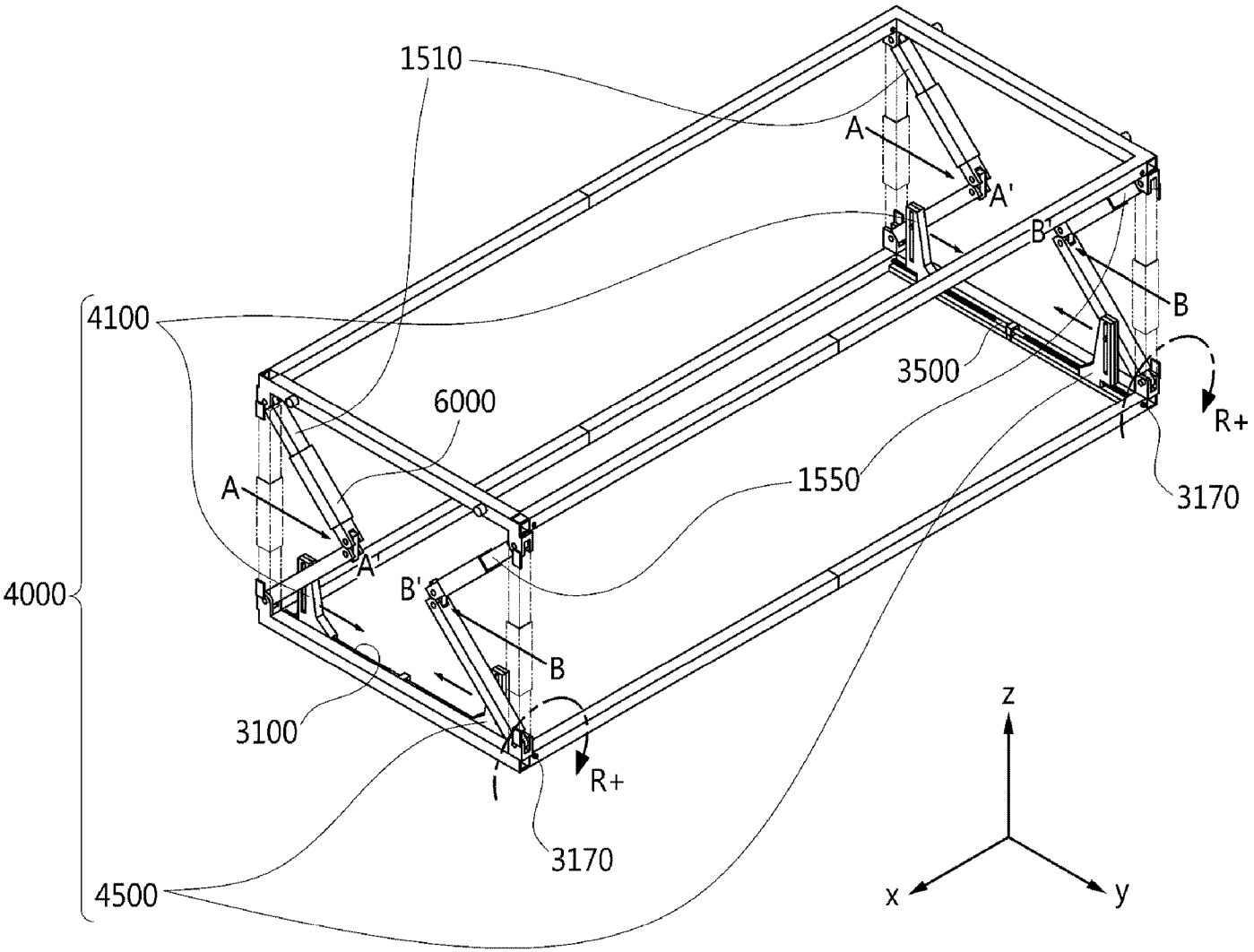
FIGS. 22 to 24 are perspective views illustrating the operation of the cargo container in FIGS. 16 and 17.
Figure 24:
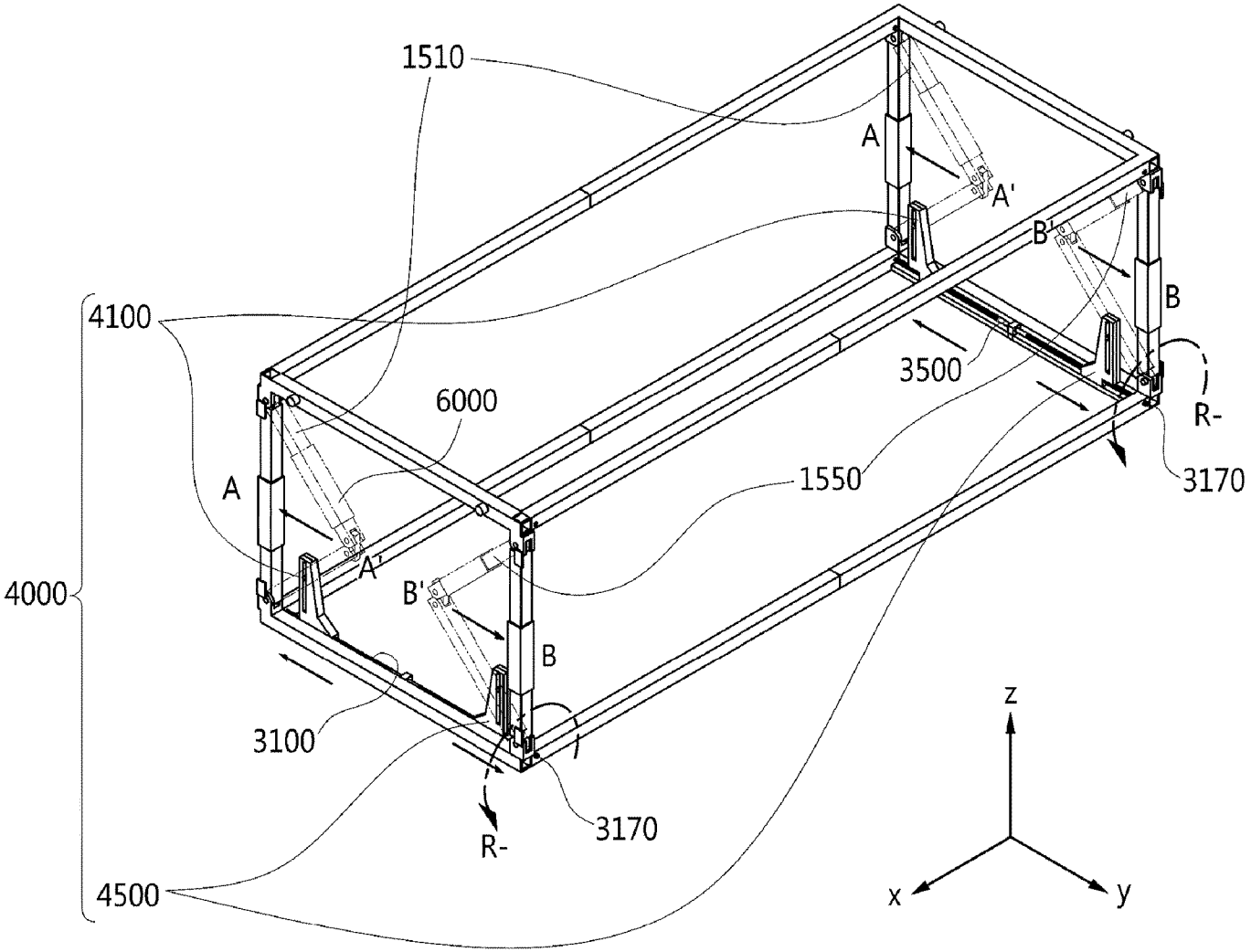

FIGS. 22 to 24 are views illustrating the operation of the cargo container in FIGS. 16 and 17. More particularly, FIGS. 22 and 23 are perspective views for explaining the operation of the cargo container in the folding mode, and FIG. 24 is a perspective view for explaining the operation of the cargo container in the fixing mode.

Referring to FIGS. 16 to 19 and 22 to 24, the cargo container may be operated in the folding mode and the fixing mode.

Before performing the folding mode, the cargo container may perform the following preparatory steps. First, the second and the fourth side panels 2530 and 2570 fixed to the frame part 1000 may be detached by the binding part 2590.

Then, the fixed bracket 6000 located at a position corresponding to the first and second frame folding lines 1515 and 1555 may be upwardly or downwardly moved with respect to the z axis, so that the side frames 1500 may be folded. Thereafter, the folding mode of the cargo container may be performed.

As described above, the folding mode and the fixing mode may be controlled according to the rotation direction of the lead screws 3000.

In the folding mode, a plurality of lead screws 3000 may be rotated by a user in one direction. For example, the lead screw 3000 may rotate in the R+ direction.

The rotation of the lead screws 3000 in the R+ direction may cause the guide brackets 4000 located at both end portions of the lead screw 3000 to move linearly in the inward direction toward the lead screw holder 3100. Herein, the guide brackets 4000 located at both end portions of the lead screw 3000 may be operated simultaneously. More specifically, when the lead screws 3000 are rotated in the R+ direction, the first guide brackets 4100 engaged with the first screw region 3153 may be linearly moved in the +y axis direction along the screw thread protruding in one direction. In addition, the second guide brackets 4500, which are engaged with the second screw region 3155, may be linearly moved in the −y axis direction along the screw thread protruding in another direction.

As the guide brackets 4000 inwardly move toward the lead screw holder 3100, the side frames 1500 connected to the guide bracket 4100 by the guide pin 4150 may be folded. More specifically, as described with reference to FIG. 18, the guide pin 4130 is formed to protrude from the side frame 1500 by a predetermined length, and at least a portion of the guide pin 4130 may be inserted into the guide road 4110 and reciprocated. Thus, when the guide road 4110 inwardly moves, the side frame 1500 may be inwardly folded by the guide pin 4130 moving along the guide road 4110.

In an exemplary embodiment, when the first guide brackets 4100 are moved in the +y axis direction, the first side frame portion 1510 may be folded while the first frame folding line 1515 is bent from the A point to the A' point (refer to FIG. 22). In addition, together with the first guide brackets 4100, when the second guide brackets 4500 are moved in the −y axis direction, the second side frame part 1550 may be folded while the second frame folding line 1555 is bent from point B to point B' (refer to FIG. 22). Herein, the first panel folding lines 2515 and 2555 formed on substantially the horizontal line with respect to the first and second frame folding lines 1515 and 1555 are simultaneously bent, so that the first and third side panels 2510 and 2550 may be inwardly folded together.

With the folding of the first and second side frame portions 1510 and 1550, the upper frames 1100 may descend in the −z axis direction. Herein, the upper frames 1100 may descend while being held substantially horizontal by the correction protruding portions 1150 moving along the correction guide grooves 2537 and 2577.

The upper frames 1100 may be moved until the bottom face of the first protruding parts 5100 and the top face of the second protruding part 5500 are in contact.

After the folding of the first and second side frame portions 1510 and 1550 by the first and second protruding parts 5100 and 5500 is completed, the second and fourth side panels 2530 and 2570 may be inwardly overlaid on by the second panel folding lines 2535 and 2575. More specifically, the second side panel 2530 may be folded in the +x axis direction by the second panel folding line 2535, and overlaid on the descended upper frame 1100. In addition, the fourth side panel 2570 may be folded in the −x axis direction by the second panel folding line 2575, and overlaid on the descended second side panel 2530. Herein, the positions of the second side panel 2530 and the fourth side panel 2570 may be interchanged. In other words, the second side panel 2530 may be overlaid on the fourth side panel 2570. Accordingly, the folding of the cargo container may be completed.

In the conventional foldable cargo container, the bottom portion and the side portions are separated and assembled in folding to reduce the volume of the container, thereby resulting in long time and user's troubles.

However, since the cargo container according to an exemplary embodiment of the present invention may be controlled only by the rotation of the lead screws without separation and assembly, it may be possible to improve the convenience of a user, increase the efficiency by reducing the volume, and reduce time and cost.

Before the fixing mode of the cargo container, the second side panel 2530 overlaid in the folding mode may stand up the fourth side panel 2570. Then, the fixing mode of the cargo container may be performed.

In the fixing mode, a plurality of lead screws 3000 may be rotated in another direction by a user. For example, the lead screw 3000 may be rotated in the R− direction.

By rotation of the lead screws 3000 in the R− direction, the guide brackets 4000 located near the lead screw holder 3100 may be outwardly moved away toward the end portions of the lead screw 3000. Herein, the guide brackets 4000 may be moved simultaneously, as described above.

As the guide brackets 4000 move outward toward both end portions of the lead screw 3000, the folded side frames 1500 may be stood up.

More specifically, in an exemplary embodiment, when the first guide brackets 4100 are moved in the −y axis direction, the first side frame portion 1510 may be stood up while the first frame folding line 1515 is moved from the point A' to the point A (refer to FIG. 22). In addition, when the second guide brackets 4500 are moved in the +y axis direction, the second side frame portion 1550 may be stood up while the second frame folding line 1555 is moved from the point B' 'to the point B (refer to FIG. 22). Herein, the first guide brackets 4100 and the second guide brackets 4500 may be moved simultaneously.

As the first and second side frame portions 1510 and 1550 are stood up, the upper frames 1100 may be ascended in the +z axis direction. The upper frames 1100 may be ascended in a substantially horizontal level by the correction protruding portions 1150 moving along the correction guide grooves 2537 and 2577.

After the first and second side frame portions 1510 and 1550 are fully erected, the first and second frame folding lines 1515 and 1555 may be fixed by the fixing brackets 6000. As a result, the first and second side frame portions 1510 and 1550 may not be folded and maintain the hexahedral shape even in case of sudden external impact.

After that, the second side panel 2530 and the fourth side panel 2570 may be fastened to the frame part 1100 again. Thus, the fixation of the cargo container may be completed.

The cargo container according to an exemplary embodiment of the present invention has been described above. The cargo container includes a frame part, a panel part, a lead screw, a guide bracket, a protruding part and a fixing bracket, and thus may be operated in the fixing mode or the folding mode according to loading or unloading of cargo. Accordingly, the volume of the container is controlled in accordance with the situation, so that it may be possible to provide a highly efficient cargo container in which the transport with stacked may be available and storage thereof may be easy.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A cargo container operated in a folding mode and a fixing mode, the cargo container comprising:

a frame part including a plurality of upper frames, a plurality of lower frames and a plurality of side frames and having a hexahedral shape;

a panel part positioned at surfaces defined by the frame part, the panel part including a side panel portion having first side panels disposed to face each other with respect to a first axis, and second side panels disposed to face each other with respect to a second axis substantially perpendicular to the first axis, a plurality of folding lines being formed at the first side panels;

a plurality of lead screws attached on the lower frames disposed to face each other with respect to the first axis, and controlling operations in the folding mode and the fixing mode according to a rotation direction;

a plurality of guide brackets penetrated by the lead screws, and moving in a reciprocating motion by rotation of the lead screws; and a correcting part including:

the lead screw penetrating both end portions of a plurality of correction brackets, and inwardly spaced apart from the guide brackets by a predetermined distance;

the lead screw penetrating both end portions of a plurality of connecting members, and inwardly spaced apart from the guide brackets by a predetermined distance;

a plurality of correction frames each having an end portion connected to the upper frame located at a side portion and another end portion connected to the correction bracket wherein in case of the folding mode, the lead screw is rotated in one direction, and the guide brackets penetrated by the lead screw, which are formed at both end portions, inwardly move in a straight line, so that the side frames, end portions of which are connected to the guide brackets, are laid down, and wherein in case of the fixing mode, the lead screw is rotated in another direction, the guide brackets penetrated by the lead screw, which are formed at both end portions, outwardly move in a straight line, so that the side frames that is laid down in the folding mode are stood up.

2. The cargo container of claim 1, wherein at least one side edge of the first side panels is fixed to the side frame.

3. The cargo container of claim 1, wherein the first side panels are folded according to the folding lines in the folding mode, before the lead screw is rotated in one direction, and overlaid on an inner side face of the second side panels.

4. The cargo container of claim 1, wherein the lead screw includes a lead screw holder and a screw region, wherein the lead screw holder is formed at a central portion of the lead screw, and a lower face of the lead screw holder is attached on an upper face of the lower frame, and wherein the screw region includes:

a first screw region located at one side with respect to the lead screw holder, wherein a screw thread protruding in a first direction is formed in the first screw region; and a second screw region located at another side with respect to the lead screw holder, wherein a screw thread protruding in a second direction is formed in the second screw region.

5. The cargo container of claim 4, wherein the guide bracket includes a body, sidewalls protruding from the body by a length and a fixing pin coupling the sidewalls to the side frame, wherein a first through-hole is formed through the body, the lead screw penetrating through the first through-hole, and wherein second through-holes are formed through the sidewalls, the fixing pin passing through the second through-holes.

6. The cargo container of claim 1, further comprising a protruding part that includes first protruding parts downwardly protruding from corner portions of the upper frames by a predetermined length and second protruding parts upwardly protruding from corner portions of the lower frames by a predetermined length, wherein in the folding mode, a lower face of each first protruding part and an upper face of each second protruding part make contact with each other.

* * * * *